United States Patent [19]

Vogel et al.

[11] 4,254,604

[45] Mar. 10, 1981

[54] CARTONER AND PRODUCT INFEED CONVEYOR THEREFOR

[75] Inventors: Walter H. Vogel, Hoffman Estates; Thomas E. Close, Joliet, both of Ill.

[73] Assignee: Redington Inc., Chicago, Ill.

[21] Appl. No.: 421

[22] Filed: Jan. 2, 1979

[51] Int. Cl.[3] ..... B65B 43/28

[52] U.S. Cl. ..... 53/566; 53/251; 53/376; 198/732; 493/313

[58] Field of Search ..... 53/564, 566, 251, 376; 198/732; 93/53 SD

[56] References Cited

U.S. PATENT DOCUMENTS

| | | | |
|---|---|---|---|
| 2,133,248 | 10/1938 | Jones | 53/251 X |
| 2,662,355 | 12/1953 | Ross | 53/566 |
| 2,999,344 | 9/1961 | Clanin et al. | 93/53 SD X |
| 3,016,808 | 1/1962 | Galloway | 93/53 SD |
| 3,162,294 | 12/1964 | Dieter | 198/732 |
| 3,613,525 | 10/1971 | Lense et al. | 93/53 SD |

*Primary Examiner*—Travis S. McGehee

*Attorney, Agent, or Firm*—Vogel, Dithmar, Stotland, Stratman & Levy

[57] ABSTRACT

A cartoner for inserting a product into an expanded carton having at least one open end and side flaps and an end panel with tuck flap thereon, and thereafter closing the open end, the cartoner accommodating a wide variety of carton shapes and sizes; a product infeed conveyor for such a cartoner including a product support plate extending laterally from either side of the cartoner and including a conveyor chain carrying product pushers pivotally mounted thereon, the product support plate being positioned from a bottom carton supporting rail a distance to receive the product pushers therethrough so that the product pushers both feed the product to the cartons and insert the product therein.

46 Claims, 17 Drawing Figures

CARTONER AND PRODUCT INFEED CONVEYOR THEREFOR

PRIOR ART STATEMENT AND BACKGROUND OF THE INVENTION

The present invention relates generally to improvements in cartoners for inserting product into expanded open cartons and thereafter closing the carton with the product therein, and specifically to the provision of a cartoner that is adjustable to handle a wide variety of carton shapes and sizes, and an improved product infeed conveyor for such a cartoner which also inserts the product into the carton.

Cartoners heretofore available for this cartoning function are illustrated in United States Letters Patent No. 2,909,874 granted Oct. 27, 1959 to C. L. Barr, United States Letters Patent No. 2,956,483 granted Oct. 18, 1960 to E. A. Hartbauer, and U.S. Letters Patent No. Re. 24,965 granted Mar. 21, 1961 to E. A. Hartbauer. Although adjustable to a certain extent, the machines illustrated in these patents were not fully adjustable over a wide range of sizes and shapes of cartons to be handled thereby. Furthermore, adjustment of the mechanism to change the size of the carton being filled was often difficult and time consuming.

The prior cartoners also required the product to be fed from a single side thereof, rather than from either side thereof, whereby at least two versions of each machine was required in order to accommodate different layouts in the factory. Furthermore, these prior machines had both an article infeed conveying mechanism and an article insertion mechanism, whereby there was substantial complexity in the product conveying and insertion mechanism for these cartoners.

SUMMARY OF THE INVENTION

The present invention provides a cartoner which is readily and quickly adjusted to accommodate a wide variety of sizes and shapes of cartons to be filled thereon, and also there is provided an improved product infeed conveyor that also inserts the product into the carton, thus simplifying the mechanism substantially.

This is accomplished in the present invention, and it is an object of the present invention to accomplish these desired results, by providing a cartoner for inserting a product into an expanded carton having at least one open end and thereafter closing the open end, wherein the cartoner is adjustable to a wide variety of carton shapes and sizes, the cartoner including an expanded carton conveyor having three conveyor chains each having equidistantly spaced lugs therealong extending therefrom, the lugs on two of the conveyor chains being in lateral alignment, the lugs on the other of the conveyor chains being longitudinally spaced therefrom to provide a pocket, mechanism supporting and driving the three conveyor chains along a path from the input end of the cartoner to the output end of the cartoner, a bottom rail supporting the cartons in the pockets and a top rail guiding the upper surface of the cartons to hold the cartons in the pockets, two of the conveyor chains being adjustable laterally toward and away from each other and the other conveyor chain to adjust the length of the pockets defined by the lugs to accommodate different lengths of cartons, the longitudinal distance between the two laterally aligned sets of lugs and the other set of lugs being adjustable to adjust the width of the pockets defined by the lugs to accommodate different widths of cartons, the top rail being adjustable toward and away from the bottom rail to adjust the depth of the pockets defined by the lugs to accommodate different depths of cartons, and expanded carton feed mechanism adjacent to the input end of the cartoner for depositing cartons one-by-one into the pockets on the expanded carton conveyor, a product infeed and filling mechanism adjacent to the cartoner between the input end and the output end thereof for depositing products one-by-one into the cartons in the pockets, and closure mechanism on the cartoner between the product infeed and filling mechanism and the output end of the cartoner for closing the cartons with the products therein.

Another object of the invention is to provide a cartoner of the type set forth wherein the product infeed and filling mechanism is adapted to be disposed on either side of the cartoner so that the product can be inserted into the carton from either side of the expanded carton conveyor.

Yet another object of the invention is to provide a cartoner of the type set forth wherein all of the conveyor chains are laterally adjustable toward and away from each other and the other conveyor chain and toward and away from the side of the carton conveyor on which the product infeed mechanism is disposed so that the conveyor chain adjacent to the output end of the product infeed mechanism can be adjusted closely thereto.

Still another object of the invention is to provide a cartoner of the type set forth wherein the product infeed mechanism also inserts the product into the cartons carried by the carton conveyor.

Yet another object of the invention is to provide a cartoner of the type set forth wherein an improved product infeed conveyor is provided including a product support plate and a conveyor chain carrying a plurality of longitudinally spaced-apart product pushers pivotally connected to the conveyor chain for pushing product along the product support plate, the output end of the product infeed conveyor being positioned immediately adjacent to one side of the carton conveyor intermediate the ends thereof with the product support plate being spaced away from the bottom carton rail a distance just to permit passage of the product pushers therebetween, and guide means for the product pushers guiding the product pushers toward the open ends of the cartons carried by the carton conveyor and up to a position immediately adjacent thereto to insert the product engaged by a product pusher into the associated open carton.

In connection with the foregoing object, it is another object of the invention to provide a cartoner of the type set forth wherein a product support plate extension is pivotally mounted adjacent to the space between the output end of the product support plate and the bottom rail for closing the space during the passage of the product thereover, the product support plate extension being pivotal out of the way of each product pusher as the product pusher reaches the bottom rail to permit passage of the product pusher downwardly between the exit end of the product support plate and the bottom rail.

Still another object of the invention is to provide a cartoner of the type set forth wherein a side flap spreader is mounted adjacent to the output end of the product infeed conveyor in position to engage and spread a side flap on the associated carton in alignment with the output end of the product infeed conveyor for receiving a product therefrom.

A further object of the invention is to provide an improved infeed conveyor of the type set forth.

Further features of the invention pertain to the particular arrangement of the parts of the cartoner and the product infeed conveyor therefor, whereby the above-outlined and additional operating features thereof attained.

The invention, both as to its organization and method of operation, together with further features and advantages thereof will best be understood with reference to the following specification taken in connection with the accompanying drawings.

DESCRIPTION OF THE PREFERRED EMBODIMENT

There is illustrated in FIGS. 1 to 6 a cartoner 100 made in accordance with and embodying the principles of the present invention and including a product infeed conveyor 400, the details of which are illustrated in FIGS. 7 to 16 of the drawings, and which also is constructed in accordance with and embodies the principles of the present invention.

Figures 1, 1A:
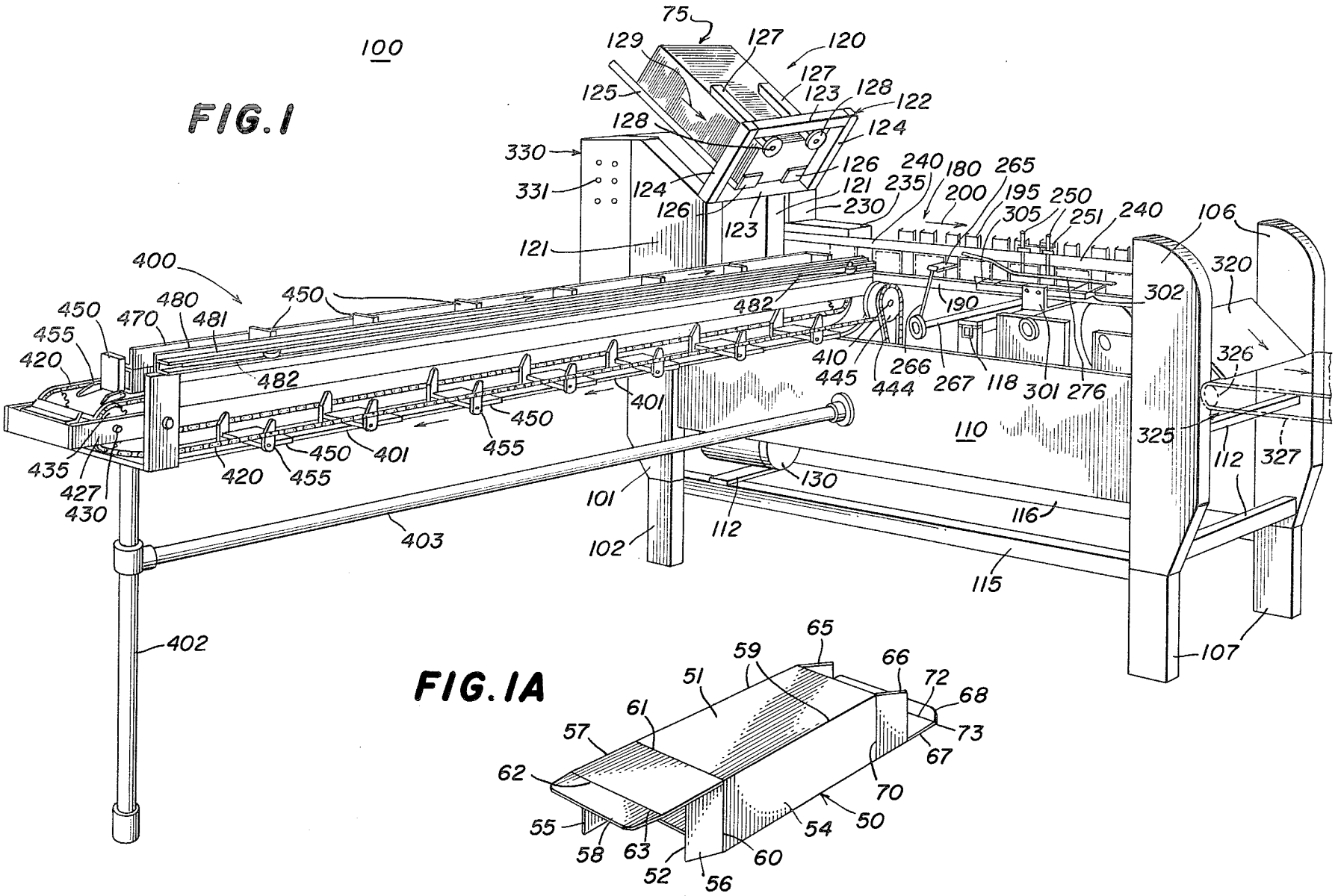
FIG. 1 is a perspective view of a cartoner and product infeed conveyor therefor made in accordance with and embodying the principles of the present invention.
FIG. 1A is a perspective view of a carton useful in the cartoner of the present invention.
Figure 2:
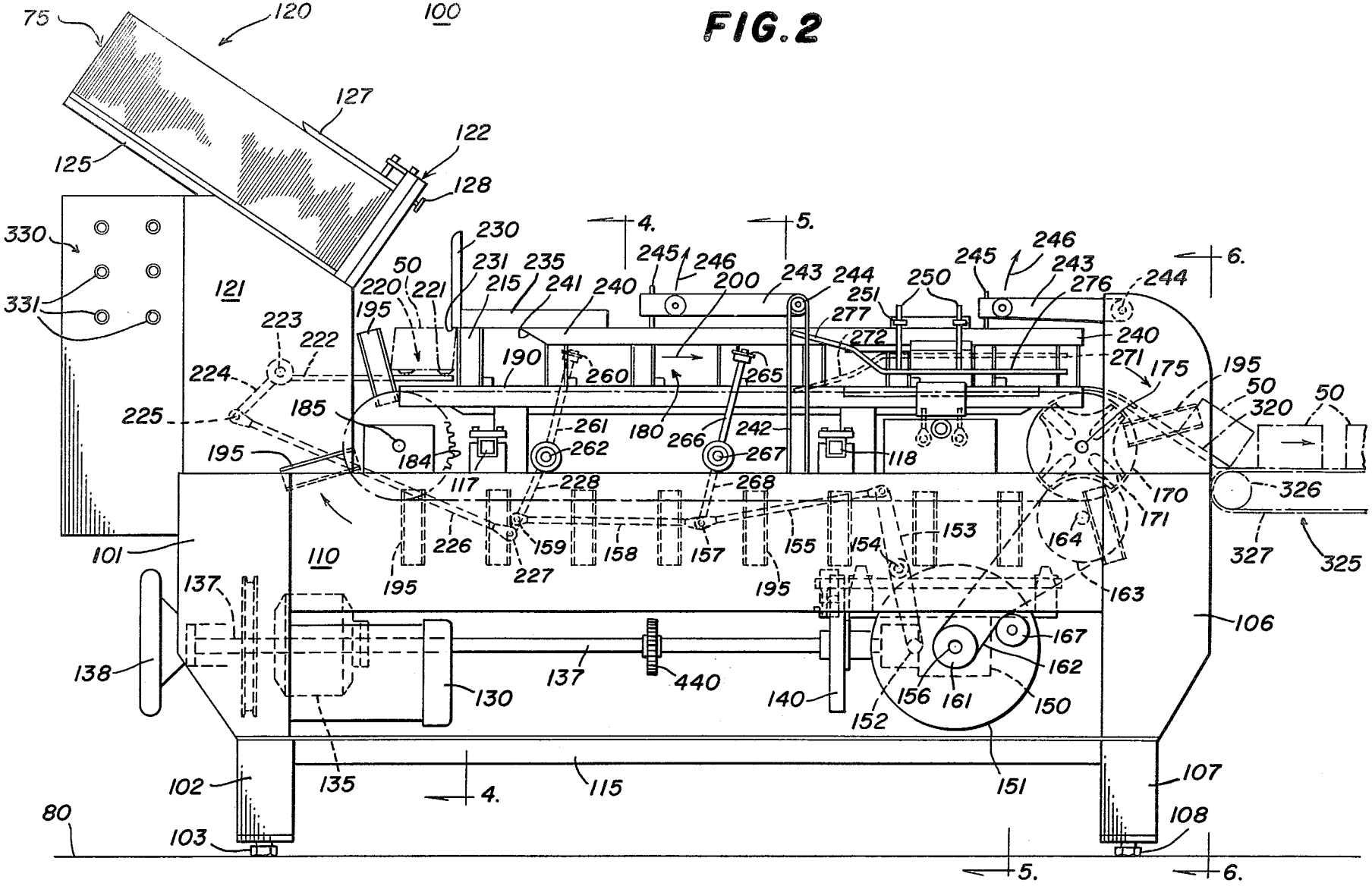
FIG. 2 is a side elevational view, with the product infeed conveyor removed, of the cartoner of FIG. 1.

Referring first to FIGS. 1 to 6 of the drawings, the cartoner 100 is supported by a suitable frame including two end frame members 101 disposed to the left in FIGS. 1 and 2, the end frame members 101 being supported by legs 102 that in turn carry adjustable feet 103 resting upon an underlying support surface 80. Disposed at the other end of the cartoner 100 are end frame members 106 supported by legs 107 and having adjustable feet 108 resting upon the support surface 80. The end frame members 101 and 106 are joined by side frame members 110 and 111, as well as longitudinal frame members 115 and 116. Cross frame members 112, 113, 114, 117 and 118 are also provided.

As illustrated, the cartoner 100 is designed and constructed to insert a generally rectangular product 90 (see FIGS. 11 and 16) into a generally rectangular carton 50 therefor, the carton 50 as illustrated in FIG. 1A being of the reverse tuck type. The carton 50 is provided with a generally rectangular top wall 51 and a correspondingly shaped bottom wall 52 joined by rectangular side walls 53 and 54. Front side flaps 55 and 56 are provided on side walls 53 and 54, respectively, while a front end panel 57 is provided on the front edge of the top wall 51, the front end panel 57 carrying a front tuck flap 58. Score lines 59 are provided at the junctures of the top wall 51, the bottom wall 52 and the side walls 53 and 54, whereby the carton 50 can be flattened. Score lines 60 are disposed at the junctures of the front side flaps 55 and 56, with the side walls 53 and 54, while a score line 61 is provided at the juncture of the front end panel 57 and the top wall 51 and a score line 62 is provided between the front end panel 57 and the tuck flap 58. A slit 63 is provided at the outer end of the score line 62 so that the front tuck flap 58 can be locked in the tucked position thereof. Rear side flaps 65 and 66 are provided at the rear ends of the side walls 53 and 54, while a rear end panel 67 is provided at the rear end of the bottom wall 52, the rear end panel 67 carrying a rear tuck flap 68. Score lines 70 are provided at the juncture of the rear side flaps 65 and 66 with the side walls 53 and 54, while a score line (not shown) is provided at the juncture between the bottom panel 52 and the rear end panel 67 and a score line 72 is provided at the juncture of the rear end panel 67 and the rear tuck flap 68.

Figure 4:
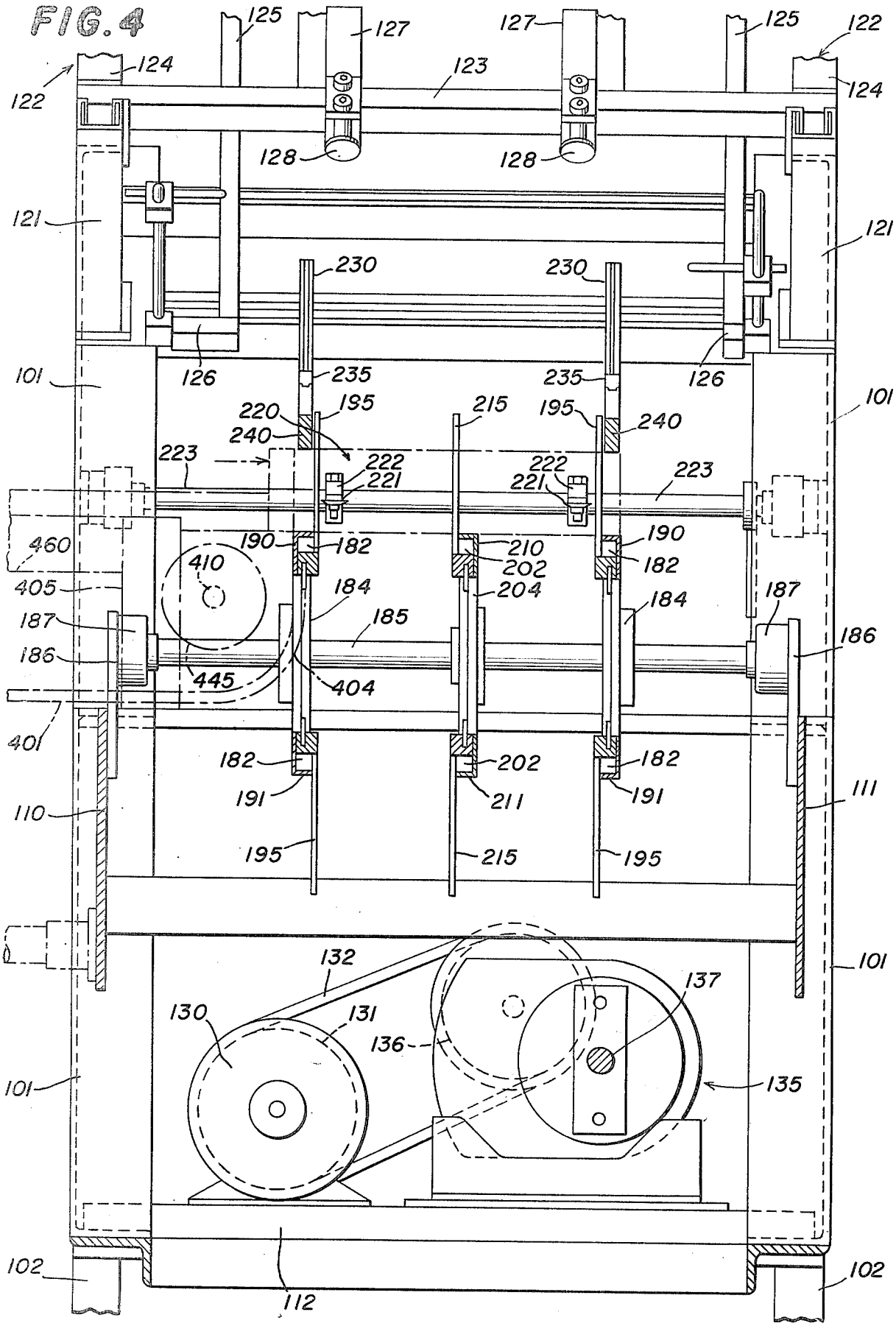
FIG. 4 is a view in vertical section along the line 4—4 of FIG. 2 on an enlarged scale.

A folded carton magazine 120 is provided on the cartoner 100 to receive a stack 75 of folded cartons 50, see FIGS. 1, 2 and 4. The magazine 120 includes a pair of upstanding support members 121 carried by the end frame members 101 and supporting on the front end thereof a rectangular frame 122 comprising two cross members 123 and two side members 124 joining the cross members 123. The frame 122 in turn supports two bottom rails 125 that are adjustable toward and away from each other on the frame 122 to accommodate different sizes of cartons 50, the lower ends of the bottom rails 125 carrying upstanding ledges 126 that assist in holding the cartons 50 in the magazine 120. Upper rails 127 are also provided and are mounted on the frame 122 and are adjustable toward and away from each other and toward and away from the bottom rails 125 so as to accommodate different sizes of the cartons 50. The forward end of each of the upper rails 127 carries a retainer 128 which also assists in holding the folded carton 50 in the magazine 120. As will be explained more fully hereinafter, the folded cartons 50 are extracted one-by-one from the stack 75, and the individual cartons 50 move down the magazine 120 in the direction of the arrow 129.

Power for operating the cartoner 100 and all the parts thereof is derived from a variable speed motor 130, see FIGS. 2 and 4 also. The motor 130 is mounted upon the cross frame member 112 and has an output pulley 131 engaging in a drive belt 132 which in turn engages the input 136 of a gear box 135. The output from the gear box 135 appears on a main shaft 137 that extends longitudinally of the cartoner 100 and provides the power for operation of all of the components thereof, a hand wheel 138 is disposed on the left-hand end of the main shaft 137 as viewed in FIG. 2 so that the machine parts may be manually set in adjusted positions for alignment and adjustment purposes.

One of the outputs from the main shaft 137 is the rotation of a tucker cam 140 which is used to drive a rear tuck mechanism 280 and a front tuck mechanism 300 to be described more fully hereinafter. Engaging in the cam track in the tucker cam 140 is a cam follower 141 (see FIG. 5 also) that is carried on an arm 142 journaled in a bearing 143. The arm 142 drives and is fixedly connected to a lever 145 that carries at each end thereof an upwardly extending link 146 that is pivotally connected to one arm of a bell crank 147, respectively, the bell crank 147 being journaled in pivot bearings 148. The connection of these parts to the tuck mechanisms 280 and 300 will be described more fully hereinafter.

The main shaft 137 also drives a bevel gear box 150 (see FIGS. 2 and 5) having an output shaft 156 driving a side flap folder and suction head cam 151. Engaging in a cam track in the cam 151 is a cam follower 152 which is mounted on and is connected to a lever 153 that is pivoted to the side frame member 111 at 154. The other end of the lever 153 is pivotally connected to a link 155 that is secured by a pivot connection 157 to another link 158 that in turn is connected to a pivot connection 159.

Figure 6:
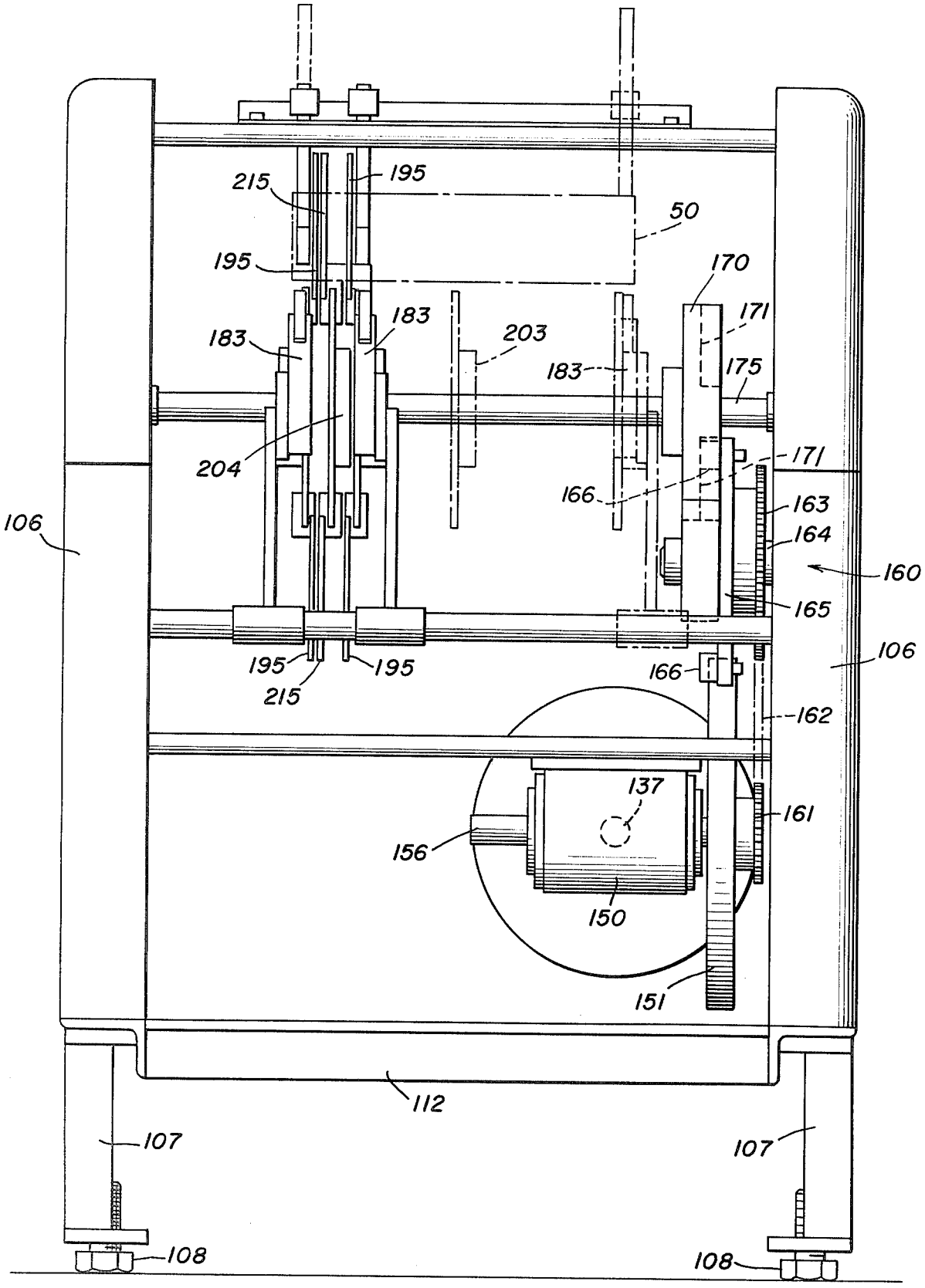
FIG. 6 is a view in vertical section along the line 6—6 of FIG. 2 on an enlarged scale.

Referring specifically to FIGS. 2 and 6, it will be seen that another output from the bevel gear box 150 powers a geneva drive generally designated by the numeral 160. There is carried on the shaft 156 an output sprocket 161 (see FIG. 6) that engages a chain 162 that also engages a drive sprocket 163 (see FIG. 2 also) fixedly secured to a geneva drive roller plate 165 rotatably mounted on a shaft 164 and carrying two rollers 166 that engage in a geneva wheel 170. In order to maintain the chain 162 in the proper driving engagement, an idler-tensioning sprocket 167 is provided. The geneva wheel 170 is provided with the usual four slots 171 which are alternately engaged by the geneva rollers 166. The geneva wheel 170 is fixedly secured to a conveyor drive shaft 175 journaled in bearings 176 (see FIG. 3 also) and serving to drive the expanded carton conveyor for the cartoner 100.

A carton conveyor 180 is provided to receive expanded cartons from the magazine 120 and to convey the expanded cartons 50 during the filling and closure thereof. The carton conveyor 180 comprises three separate conveyor chains and associated lugs, namely, two pushing or trailing conveyors 181 carrying lugs 195 and a leading conveyor 201 carrying lugs 215 and disposed between the trailing conveyors 181. Each of the trailing conveyors 181 comprises a chain 182 supported by drive sprockets 183 mounted on the conveyor drive shaft 175 (see FIG. 6) and idler sprockets 184 mounted on an idler shaft 185 (see FIG. 4) that is journaled in bearings 187 supported by mounting plates 186.

Figure 3:
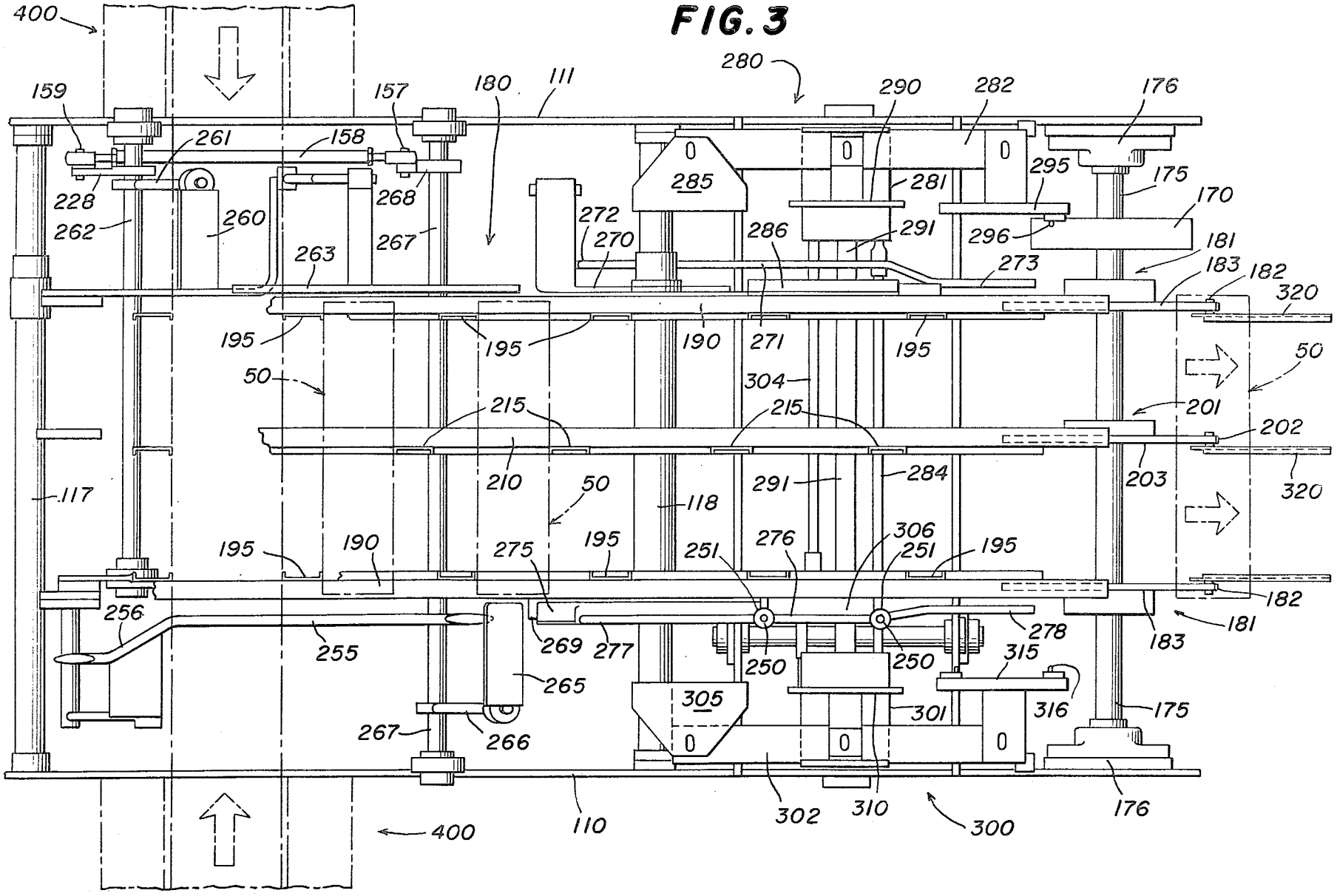
FIG. 3 is a plan view of a portion of the cartoner of FIG. 2.

Extending longitudinally of the cartoner 100 are two bottom carton rails 190 that are associated respectively with the sprockets 183–184. The bottom carton rails 190 serve also to guide and protect the conveyor chains 182 associated therewith (see FIG. 4). A bottom chain support 191 is also provided along the lower reach of the chains 182 so as to support and protect the lower reaches of the chains 182. Each of the trailing conveyors 181 carries a plurality of the outwardly extending lugs 195 which engage the rear of an expanded carton as the carton is being conveyed along the bottom carton rails 190. The lugs 195 are spaced apart a distance at least equal to the greatest width of a carton 50 to be conveyed thereby, and the length of the lugs 195 is at least equal to the maximum height of a carton 50 to be conveyed thereby. Referring to FIGS. 2 and 3, it will be seen that the expanded cartons 50 are conveyed from left to right or in the direction of the arrows 200.

In order to maintain the expanded carton 50 in the expanded condition, the leading conveyor 201 is provided that is disposed between the trailing conveyors 181. The leading conveyor 201 includes a continuous chain 202 that is driven by a sprocket 203 fixedly mounted on the drive shaft 175 (see FIG. 6) and an idler sprocket 204 on the idler shaft 185 (see FIG. 4). A bottom carton rail 210 is associated with the leading conveyor 201, the rail 210 also serving to enclose and protect the upper reach of the chain 202. A bottom chain support 211 is provided to cover and protect the lower reach of the chain 202. Disposed along the length of the chain 202 are the lugs 215 extending outwardly therefrom and being shaped and arranged like the lugs 195 described above. In order to maintain the associated carton 50 in the expanded condition thereof, the lugs 215 are spaced from the associated pair of lugs 185 a distance equal to the width of the carton 50 being conveyed, the three cooperating lugs 195 and 215 forming a pocket receiving the associated expanded carton 50.

A folded carton is removed one-by-one from the magazine 120, and specifically the stack 75 of cartons 50 therein, by means of a suction head 220 (see FIGS. 2 and 4). The suction head 220 as illustrated carries four suction members 221 arranged in pairs on two arms 222 that are fixedly secured to a pivot shaft 223. Also secured to the pivot shaft 223 is a lever 224 which is pivotally connected as at 225 to a link 226. The other end of the link 226 is secured by a pivot connection 227 to the lower end of a lever 228, the lever 228 having the pivot connection 159 thereon connecting it to the link 158 described above. As the side flap folder and suction cam 151 is rotated by the drive connection thereof to the motor 130, the cam follower 152 is driven through a path which causes the lever 153, the links 155 and 158, and the link 226 and the lever arm 224 to drive the arm 222 and the suction member 221 thereon through a motion that extracts a folded carton 50 from the stack 75 thereof in the magazine 120 and deposits the same into one of the pockets on the carton conveyor 180 and against expander guides 230 (see FIG. 4 also) mounted adjacent to the magazine 120 in a stationary fashion. The leading score line on the folded carton 50 is urged against the expander guides 230 which serve to expand the carton 50 and eventually the expanded carton 50 drops below shoulders 231 provided on the guides 230 which serve to assist in holding the carton 50 in the expanded position. The trailing edge of the carton 50 is contacted by the trailing lugs 195 and this serves further to expand the carton 50 and to move the carton 50 under the entry sections 235 of two top carton rails 240, the undersides of the sections 235 being disposed at a higher level than the undersides of the carton rails 240 and being connected thereto by inclined surfaces 241. The carton 50 is thereby fed under the entry sections 235, and down the inclined surfaces 241 and under the top carton rails 240 firmly to press the carton 50 in the associated pocket defined by the two trailing lugs 195, the leading lug 215, the bottom carton rails 190 and 210 and the top carton rails 240 (see FIGS. 3 and 4 also). Each of the top carton rails 240 is mounted for vertical adjustment by means of two connectors 245 (see FIG. 2) that are secured at one end to the top rail 240 and are adjustably secured at the other ends to the arms 243 (see FIG. 2). The arm 243 to the left of FIG. 2 is mounted on a bracket 242 fixedly secured to the cartoner frame and pivotally connected as at 244, while the right-hand arm 243 as viewed in FIG. 2 is pivotally connected as at 244 to the cartoner frame. The connectors 245 can vertically position the top carton rail 240 with respect to the bottom carton rails 190 and 210 so as to accommodate different heights in the cartons 50. The arms 243 furthermore can be readily manually pivoted upwardly about the pivots 244 temporarily to raise the top carton rail 240 if it is desired to make any adjustment or clear any obstruction in the cartoner 100 in the carton conveying area, the arms 243 being pivotable upwardly and to the right in the direction of the arrows 246.

The cartons 50 are fed into pockets on the carton conveyor 180 with the expanded carton in the position illustrated in FIG. 1A. More specifically, the top wall 51 is disposed upwardly with the attached front end panel 57 extending forwardly or to the left as viewed in FIGS. 1 and 1A. In order to insure that the end flap 57 is raised so as to present an open end of the carton 50 to the product infeed conveyor 400, a holder 255 (see FIG. 3) is provided having an entry end 256 that engages under the front end panel 57 and raises it upwardly and holds it in an elevated position until the product from the conveyor 400 is inserted into the carton from the front or from the bottom as viewed in FIG. 3.

While the product is being inserted into the carton 50, the rear trailing side flap 65 is being folded forwardly by a folder 260 mounted on an arm 261 that is fixedly secured to a shaft 262. Movement of the folder 260 is under the control of the cam 151 (see FIG. 2) through the linkage including the cam follower 152, the lever 153, the links 155 and 158 and the lever 228. The forwardly folded rear trailing side flap 65 is next engaged by a side flap rail 263 which has heretofore folded the leading rear side flap 66 to the closed position, the rail 263 also holding the side flap 65 in the closed position. Next the leading front side flap 52 is engaged by a front side flap rail 269 to close the same and the trailing front side flap 55 is folded forwardly to the closed position by a folder 265. The folder 265 is mounted on an arm 266 fixed to the shaft 267 which in turn has fixedly secured thereto a lever 268 that is pivotally connected to the pivot connection 157. The folder 265 is also driven from the cam 151 through the cam roller 152, the lever 153 and the link 155.

The rear end panel 67 is initially folded upwardly by a rear breaker 270, after which the end panel contacts the end panel guide 271, and specifically the leading end 272 thereof that is spaced away therefrom sufficient so that the end panel is maintained at an obtuse angle with respect to the associated bottom panel. As will be described more fully hereinafter the guide 271 has a closing end 273 that pushes the end panel 67 to the final closed position thereof as will be described more fully hereinafter.

The front end panel 57 is initially folded by a front breaker 275 after which it contacts an end panel guide 276 having a leading end 277 that holds the end panel 57 at an obtuse angle with respect to the top wall 51. As will be explained more fully hereinafter, the closing end 278 on the guide 276 moves the front end panel to the final closed position, all as will be described more fully hereinafter. In order to accommodate front end panels of different lengths that correspond to different heights of the carton 50, the end panel guide 276 is adjustable vertically, and to that end is supported by two supports 250 secured by adjustable connections 251, see FIG. 2 also.

Figure 5:
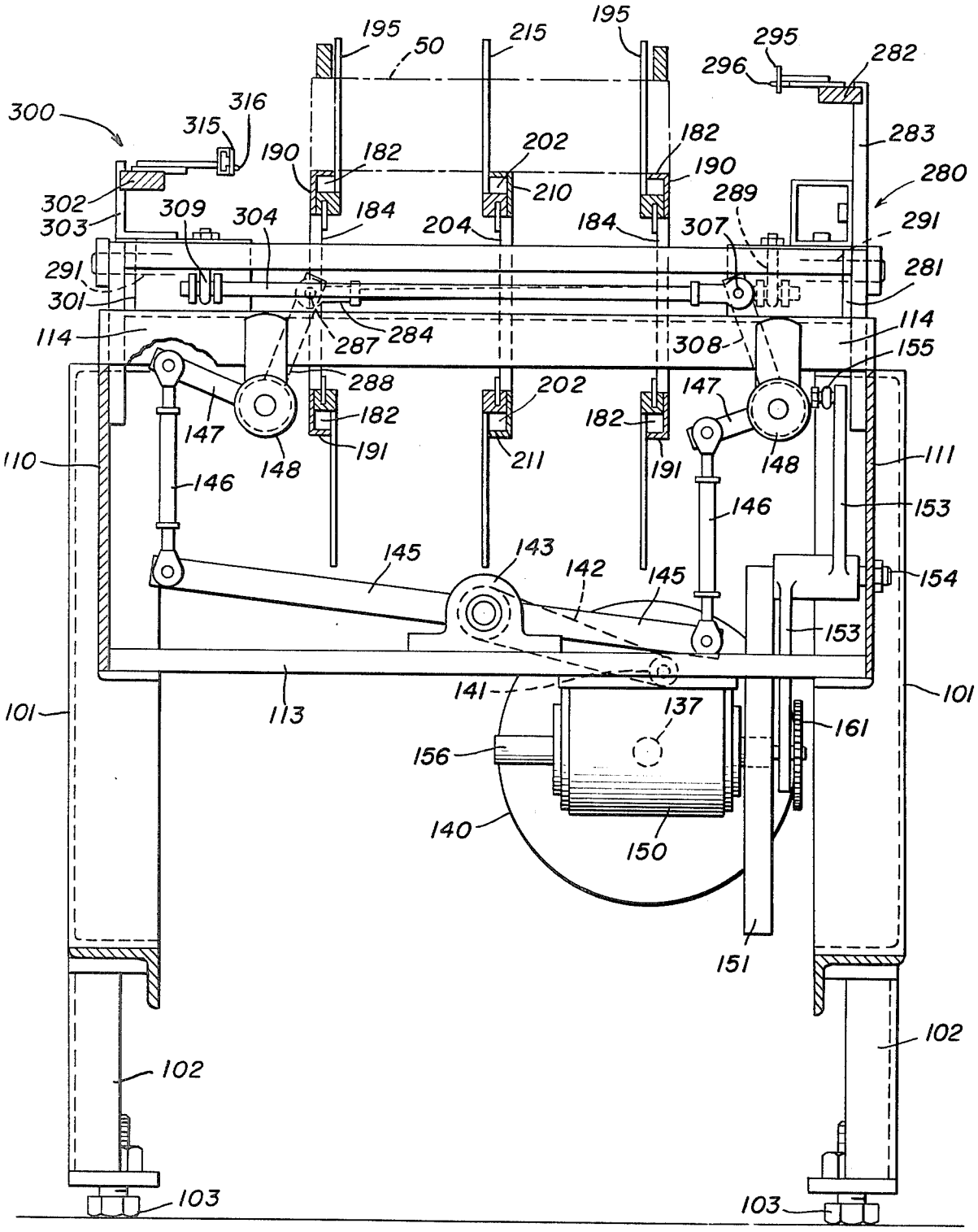
FIG. 5 is a view in vertical section along the line 5—5 of FIG. 2 on an enlarged scale.

The rear tuck mechanism 280 is best illustrated in FIGS. 3 and 5 of the drawings and includes a tucker slide 281 mounted on a slide shaft 291 and supporting a tucker carrier bar 282 through an adjustable mount 283, the mount 283 permitting vertical adjustment of the tucker carrier bar 282 to accommodate different heights of cartons 50. The tucker slide 281 is controlled by a link 284 pivotally connected as at 287 to a lever 288 that is fixedly secured with respect to the bell crank 147, the other end of the link 283 being secured by a connector 289 to the tucker slide 281. The tucker carrier bar 282 carries a tuck flap breaker 285 (see FIG. 3) which engages the rear tuck flap 68 and imparts the initial fold thereto with respect to the rear end panel 67, a tuck flap aligner 286 holding the tuck flap 68 in the proper position. A first tucker 290 is also mounted upon the tucker carrier bar 282 and serves to provide an initial insertion of the rear tuck flap 68 into the carbon 50. There also is provided a second tucker 295 on the tucker carrier bar 282 which in cooperation with the closing end 273 on the end panel guide 271 serves to make the final insertion of the rear tuck flap 68 into the associated carton 50. The second tucker 295 also carries a pin 296 which insures that the slits 73 between the rear tuck flap 68 and the rear end panel 67 are engaged within the carton 50 to lock the rear end panel 67 in the final locked position.

The front tuck mechanism 300 is also best illustrated in FIGS. 3 and 5 of the drawings and includes a tucker slide 301 mounted on the slide shaft 291 and supporting a tucker carrier bar 302 through a fixed mount 303. The tucker slide 301 is controlled by a link 304 pivotally connected as at 307 to a lever 308 that is fixedly secured with respect to the associated bell crank 147, the other end of the link 304 being secured by a connector 309 to the tucker slide 301. The tucker carrier bar 302 carries a tuck flap breaker 305 (see FIG. 3) which engages the front tuck flap 58 and imparts the initial fold thereto with respect to the front end panel 57, a tuck flap aligner 306 holding the front tuck flap 58 in the proper position. A first tucker 310 is also mounted upon the tucker carrier bar 302 and serves to provide an initial insertion of the front tuck flap 58 into the carton 50. There also is provided a second tucker 315 on the tucker carrier bar 302 which in cooperation with the closing end 278 on the end panel guide 276 serves to make the final insertion of the front tuck flap 58 into the associated carton 50. The second tucker 315 also carries a pin 316 which insures that the slits 63 between the front tuck flap 58 and the front end panel 57 are engaged within the carton 50 to lock the front end panel 57 in the final locked position.

After the filled carton 50 has been fully closed, it arrives at output slide bars 320 (see FIGS. 1, 2, and 3) which guide the carton 50 to an output conveyor 325 that includes a mounting pulley 326 and a conveyor belt 327.

The controls for the drive motor 130 are mounted on a control panel 330 (see FIGS. 1 and 2), the control panel 330 carrying the usual control buttons 331.

The cartoner 100 includes a product infeed conveyor generally designated by the numeral 400 and best illustrated in FIGS. 1, 4, and 7 to 16 of the drawings. A main support plate 401 is provided that extends from the main cartoner frame (see FIG. 4) outwardly and to the left as viewed in FIGS. 1, 4, 8, and 11 and is supported at the outer end on a leg 402 that is braced with respect to the side frame member 110 by a brace 403. The front end of the plate 401 is upturned as at 404 (see FIGS. 4, 8, and 16) and terminates at the adjacent lower carton rail 190. Disposed to the right of the side frame member 110 is a U-shaped bracket 405 that is secured to an angle iron 406 that in turn is fixedly secured to the side frame member 110. Straps 407 extend forwardly from each of the legs of the U-shaped bracket 405 and support thereon a product infeed drive shaft 410 supported in bearings 411 carried by the straps 407. Mounted on and driven by the shaft 410 are two chain support sprockets 415, each of which supports and drives a conveyor chain 420. The rear portions of the chains 420 are supported by two idler studs 430 which are supported by a U-shaped bracket 425 secured to the leg 402 and the main support plate 401; more specifically, the bracket 425 has two rearwardly extending straps 427 thereon that support the studs 430 on which the idler sprocket bearings 431 are turning. The idler support sprockets 435 are turning on bearings 431 supporting the rear portions of the conveyor chains 420. The rear end of the straps 427 are connected by a cross piece 428.

Figure 8:
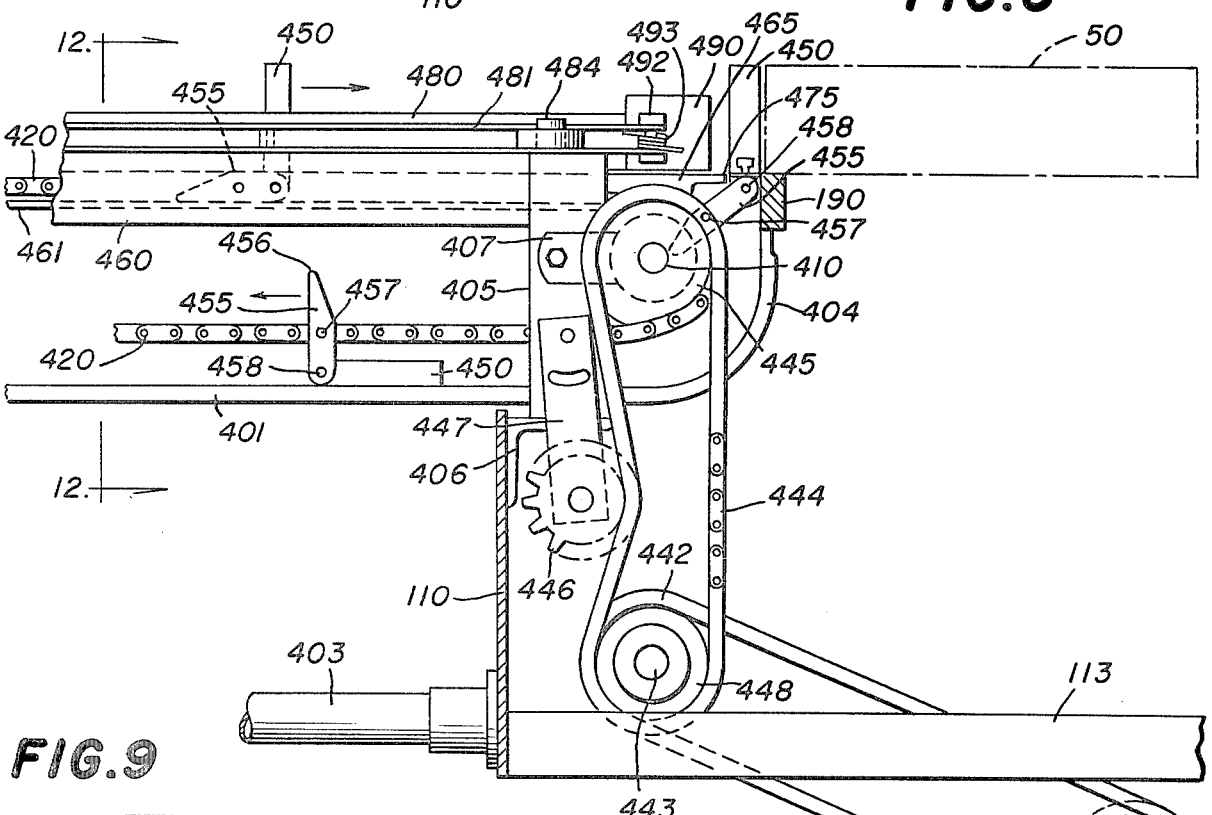
FIG. 8 is a side elevational view of the portion of the product infeed conveyor illustrated in FIG. 7.

The conveyor chains 420 are driven from the cartoner main shaft 137, and particularly from a drive sprocket 440 fixedly secured thereto (see FIGS. 2 and 8). The sprocket 440 drives a chain 441 that in turn engages a sprocket 442 mounted on a shaft 443 journalled in bearings on the cross frame member 113. The shaft 443 also carries a sprocket 448 driving a chain 444 that engages the sprocket 445 on the drive shaft 410 described above. A tensioning sprocket 446 is also provided on the bracket 447 to keep the drive chain 444 in proper tensioned condition. In this manner, the main drive shaft 137 on the cartoner 100 drives the conveyor chains 420 on the product infeed conveyor at a continuous uniform rate.

Mounted on the chains 420 are a series of longitudinally spaced-apart product pushers 450 which have secured thereto at the bottom thereof a spring metal mounting plate 451, the mounting plate 451 extending outwardly beyond the lateral sides of the product pushers 450 and carrying downwardly directed U-shaped brackets 452 on each end thereof. For each of the product pushers 450, there are provided two pusher carriers 455 formed of polyurethane plastic, one being disposed on either side thereof and including a reduced portion that fits within one of the U-shaped brackets 452 and receives therethrough a pin 458 pivotally to mount the product pusher 450 through the bracket 452 to the associated pusher carriers 455. The pusher carriers 455 are generally rectangular in shape but have a pointed trailing end 456 and are pivotally secured to the adjacent conveyor chain 450 by a mounting pin 457. Recapitulating, two pusher carriers 455 are respectively pivotally connected by the pins 457 to the conveyor chains 420, and each of the pusher carriers 455 is in turn pivotally mounted by the pins 458 to the product pusher 450.

In order to support and guide the parts during the conveying of products 90 pushed by the product pushers 450, two support rails 460 have been provided on either side of the upper reach of the chains 420 (see FIG. 12 particularly), each of the support rails 460 being U-shaped in cross section with the open side thereof disposed inwardly toward each other. A lower guide rail plate 461 is supported by the rails 460 and is secured thereto by fasteners 463, the plate 461 supporting the upper reaches of the chains 420, and more specifically supporting the pusher carriers 455 as the pusher carriers 455 move along with the upper reach of the respective chains 420. Upper guide rails 462 are secured to the inner surface of the upper leg of each support rail 460 so as to overlie and guide the outwardly extending portions of the mounting plates 451. The guide rail plate 461 at the front end thereof terminates at approximately the vertical center line through the drive shaft 410 and at the rear end thereof is downturned to provide a downwardly inclined portion as at 464. Also carried by the guide rail plate 461 is a product bed plate or product support plate 465 that is formed of high density polyethylene plastic and is secured to the plate 461 by fasteners 466. The product support plate 456 supports the product 90 as it is being pushed by the product pushers 450, the forward end of the product support plate 465 terminating at a point that is spaced from the adjacent carton guide rail 190 such that the product pushers 450 can just pass therebetween, see FIG. 16. The upper guide rails 462 have the forward ends thereof extending to a point spaced just a short distance from the carton conveyor rail 190 and the rear end thereof is curved downwardly as at 467 and is provided with a rearwardly extending flange 468 receiving therethrough fasteners 469 to secure the same to the cross piece 428.

In order to maintain the product in the proper lateral position on the product support plate 465, two side guide rails 470 and 480 have been provided. The side guide rail 470 is fixed with respect to the product support plate 465 and is more specifically positioned by a mounting bracket 471 fixedly secured to the left-hand support rail 460 as viewed in FIG. 12. The side guide rail 480 is adjustable as to position and to that end is provided with a longitudinally extending mounting bracket 481 that is supported by two arms 482, each of the arms 482 being pivotally secured by pivotal connections 483 to the mounting bracket 481. Two support shafts 484 are provided that pivotally support respectively the other ends of the arms 482 (see FIGS. 7, 10 and 12). The side guide rail 480 is therefore manually adjustable as to position toward and away from the fixed side guide rail 470 so as to accommodate different widths of product 90 being guided thereby.

As product 90 is about to be inserted into a carton 50 on the conveyor 180, it is necessary that the leading side flap 56 be held out of the associated opening to insure easy and correct entry of the product 90 into the expanded carton 50. To this end, a side flap spreader 490 is mounted on the movable side guide rail 480 (see FIGS. 7 and 8), the side flap spreader 490 being mounted on a support arm 491 that is pivotally mounted upon a pivot post 492 and is biased toward the position illustrated in FIG. 7 by a spring 493. As the carton 50 is fed past the spreader 490, the leading side flap 56 moves beyond or below the spreader 490 as viewed in FIG. 7, and as product 90 is pushed against the side flap spreader 490, the side flap spreader 490 pushes the leading side flap 56 out of the way to insure easy insertion of the product 90 into the carton 50.

Figure 7:
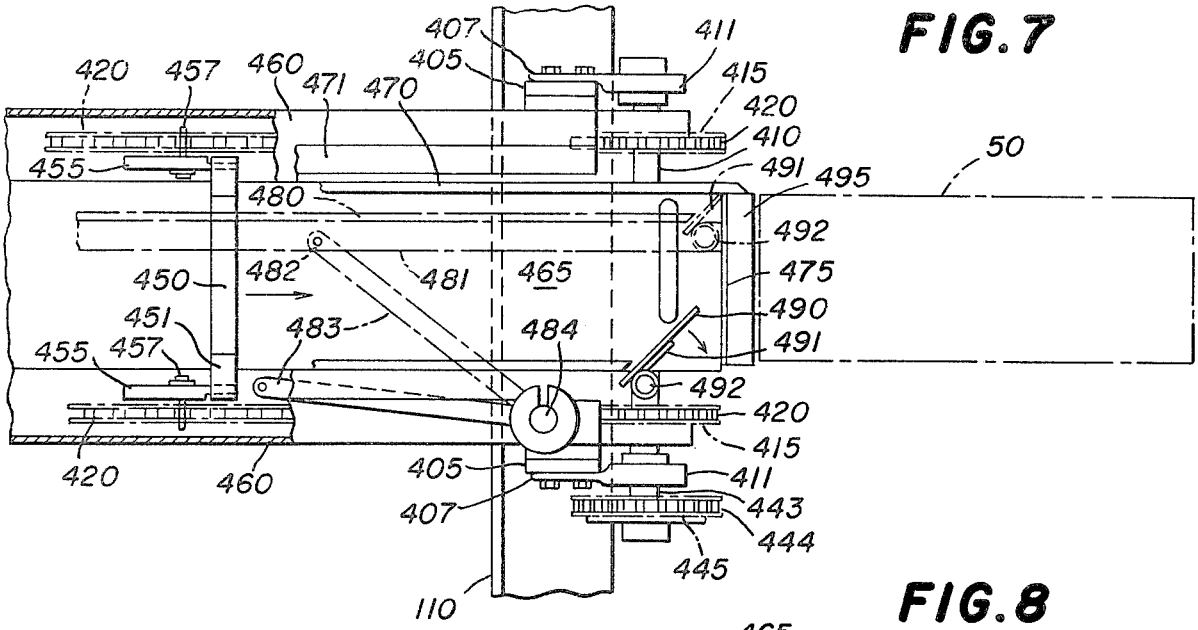
FIG. 7 is a fragmentary plan view of the output end of the product infeed conveyor illustrated in FIG. 1.
Figure 9:
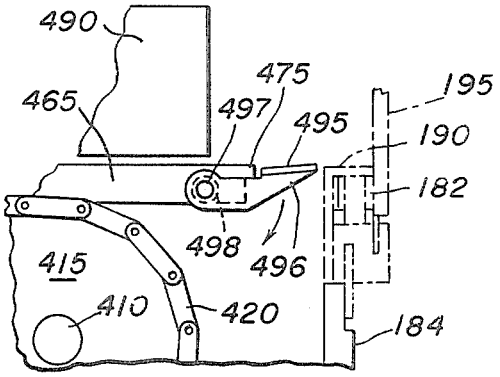
FIG. 9 is a fragmentary view on an enlarged scale of the output end of the product infeed conveyor illustrating the product support plate extension.
Figure 10:
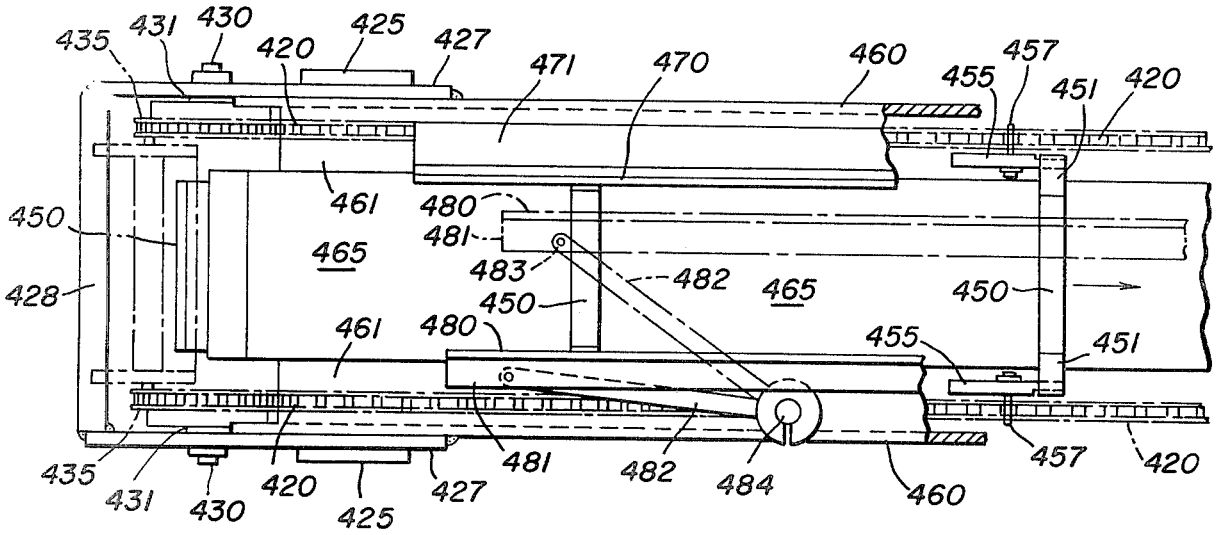
FIG. 10 is a plan view with certain portions broken away of the input end to the product infeed conveyor of FIG. 1.
Figure 11:
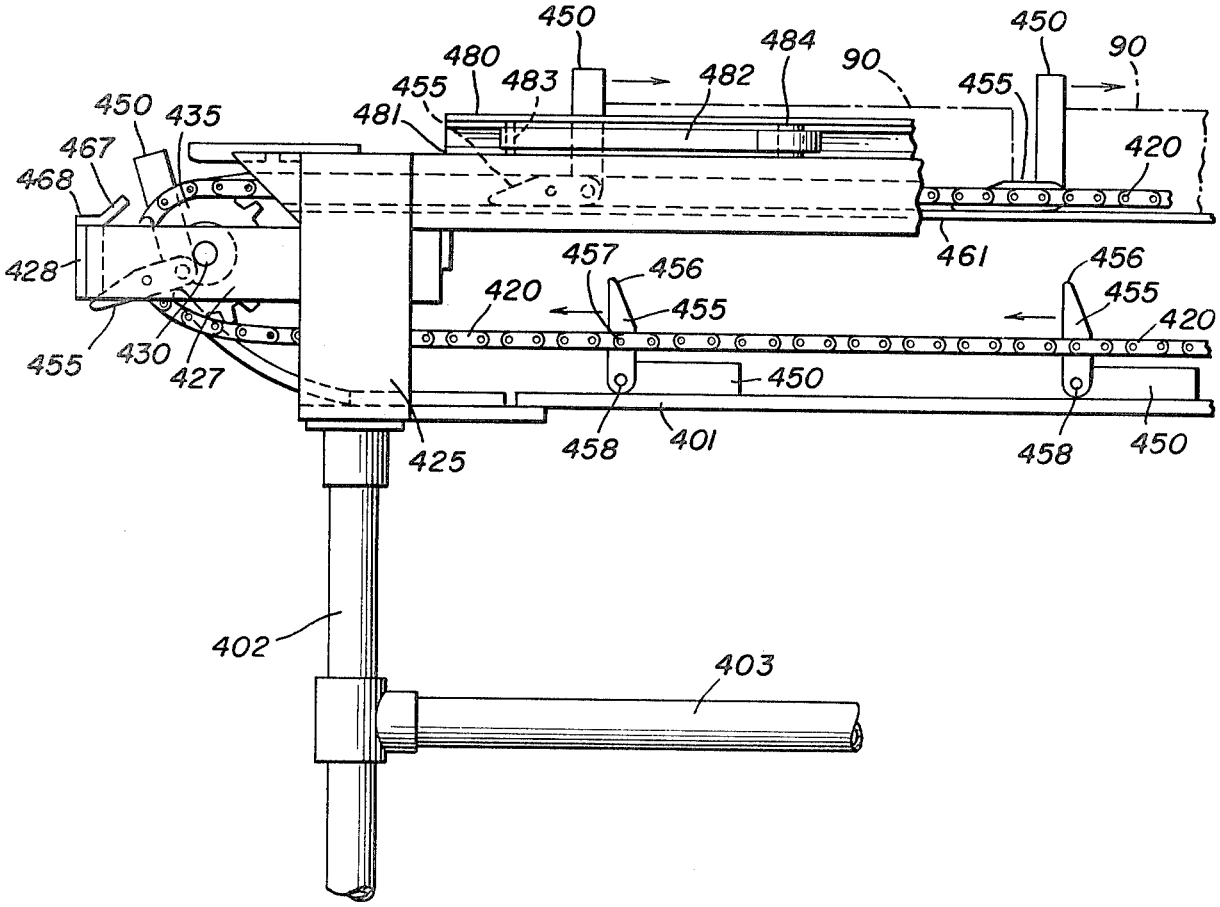
FIG. 11 is a side elevational view of the portion of the product infeed conveyor illustrated in FIG. 10.
Figure 12:
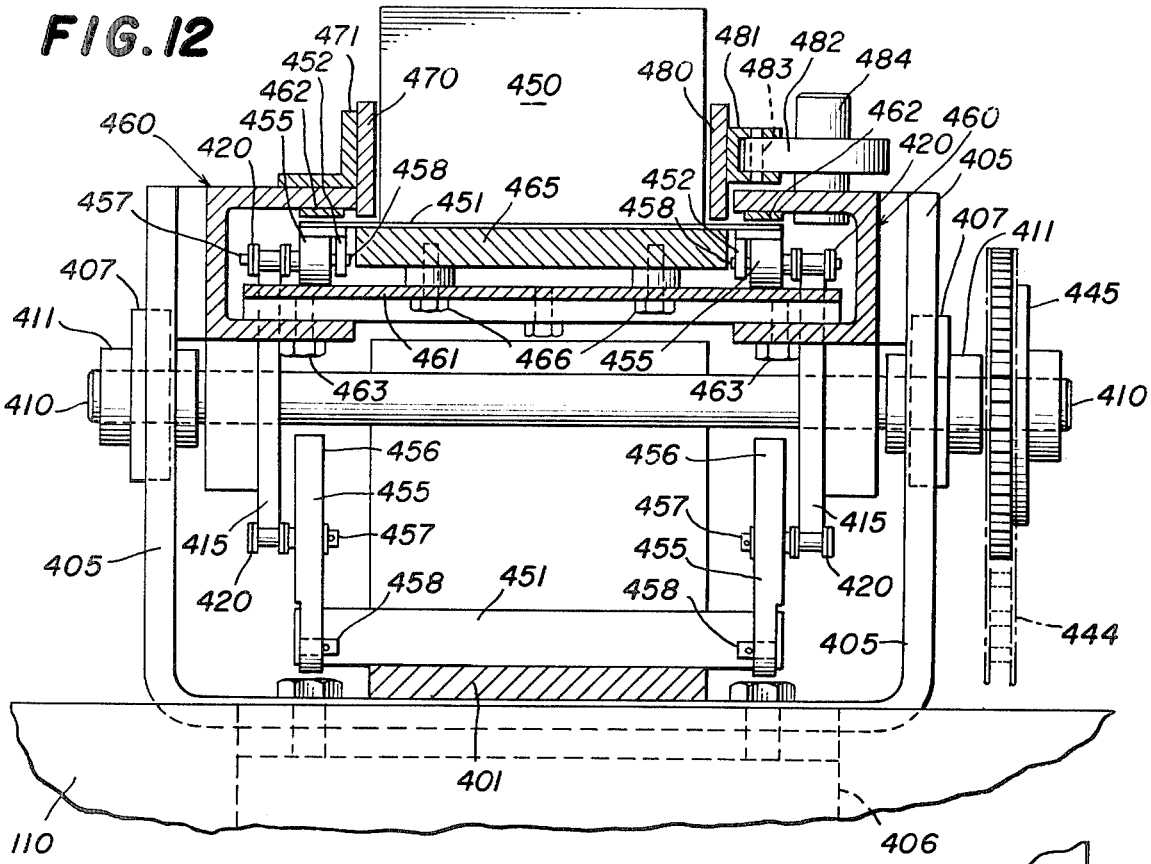
FIG. 12 is a view in vertical section on an enlarged scale along the line 12—12 of FIG. 8.
Figure 13:
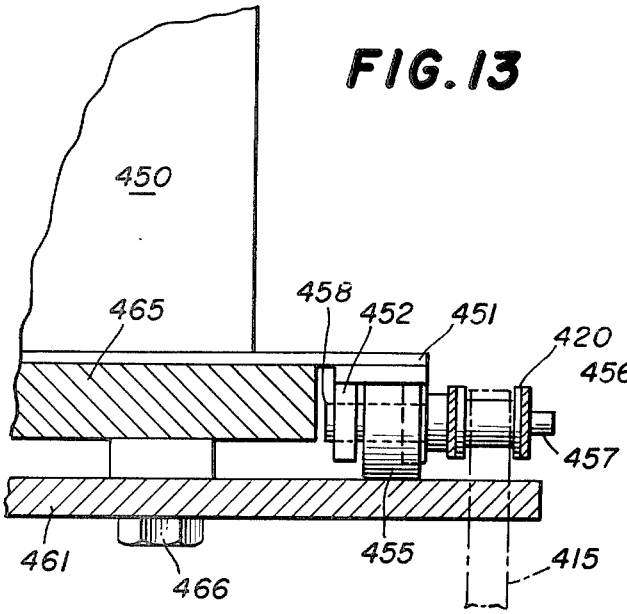
FIG. 13 is a fragmentary view on an enlarged scale in vertical section illustrating the mounting of the product pusher on the product infeed conveyor chain.
Figure 14:
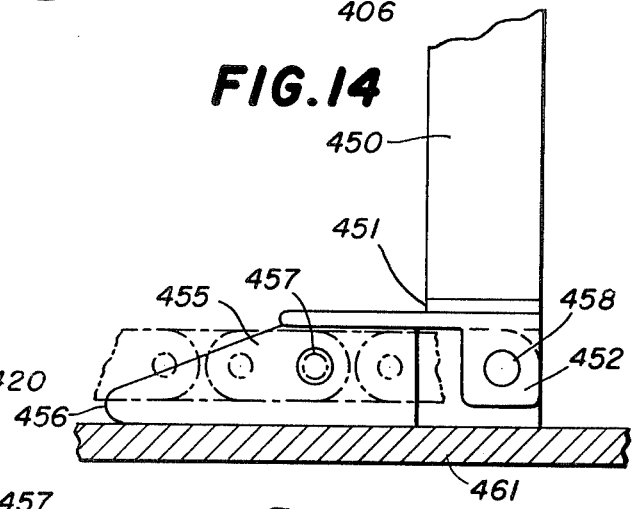
FIG. 14 is a side view of the parts illustrated in FIG. 13.
Figure 15:
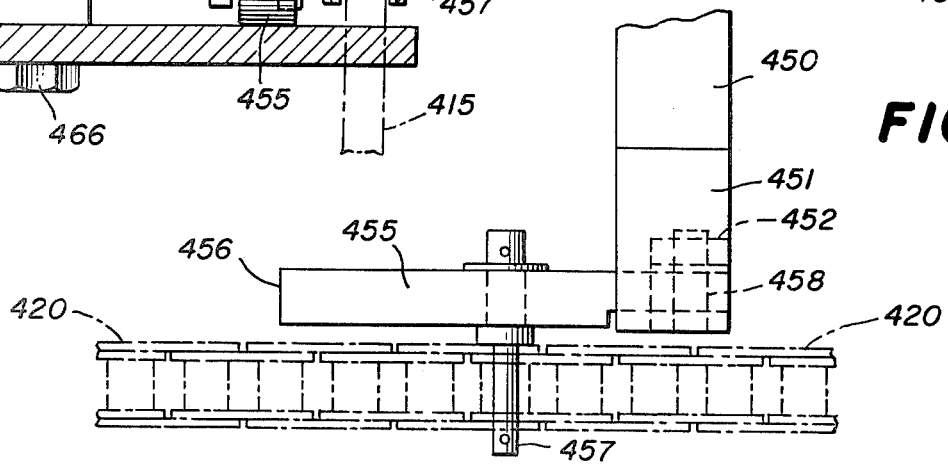
FIG. 15 is a plan view of the parts illustrated in FIGS. 13 and 14.

It also has been found that insertion of the product 90 into the carton 50 is facilitated if the space between the forward end 475 of the product support plate 465 and the bottom carton rail 190 is filled, and to this end there is provided a product support plate extension 495 (see FIGS. 7 and 9). The extension 495 is mounted on an arm 496 which in turn is pivoted about a shaft 497 affixed to the product support plate 465. A spring 498 continually urges the extension 495 into the filling position illustrated in FIG. 9. Movement of a product pusher 450 through the space between the forward edge 475 of the product support plate 465 and the bottom carton rail 190 pivots the extension 495 against the action of the spring 498 out of the way to permit passage of the product pusher 450 thereby.

In the operation of the product infeed conveyor 400, the upper reaches of the chains 420 are moving toward the right in FIGS. 7 and 8, 10, 11 and 16, while the lower reaches of the chains 420 are moving to the left in those figures. As product pushers 450 are carried around the idler sprocket 435, the pusher carriers 455 have the bottom surfaces thereof carried onto the inclined portion 464 of the guide rail plates 461 and the upper surfaces of the mounting plates 451 of the product pushers 450 are engaged by the curved portion 467 of the upper guide rails 462, whereby to maintain the product pushers 450 in the upright pushing positions thereof. Product 90 is deposited onto the product support plate 465 adjacent to the idler sprocket 435 and thereafter is pushed by the product pushers 450 to the right and toward the carton conveyor 180. As the product pusher 450 and the product 90 pushed thereby approach the carton conveyor 180, a carton 50 is positioned in alignment with the path of the product 90, and the product pusher 450 pushes the product across the product support plate extension 495 and into the open carton 50 while the open carton 50 is being held stationary due to the step-by-step drive characteristics of the geneva drive 160. It will be understood that the side flap spreader 490 has engaged the leading front side flap 56, whereby movement of the product 90 against the spreader 490 will force the front side flap 56 to an open position thus permitting ready entry of the product 90 into the stationary carton 50. It is pointed out that due to the fact that the front surface of product pusher 450 comes up essentially to the adjacent vertical surface of the carton rail 190, the product infeed conveyor 400 acting through the product pushers 450 serve not only to feed the product 90 to the carton 50, but also serves to insert the product 90 thereinto.

Figure 16:
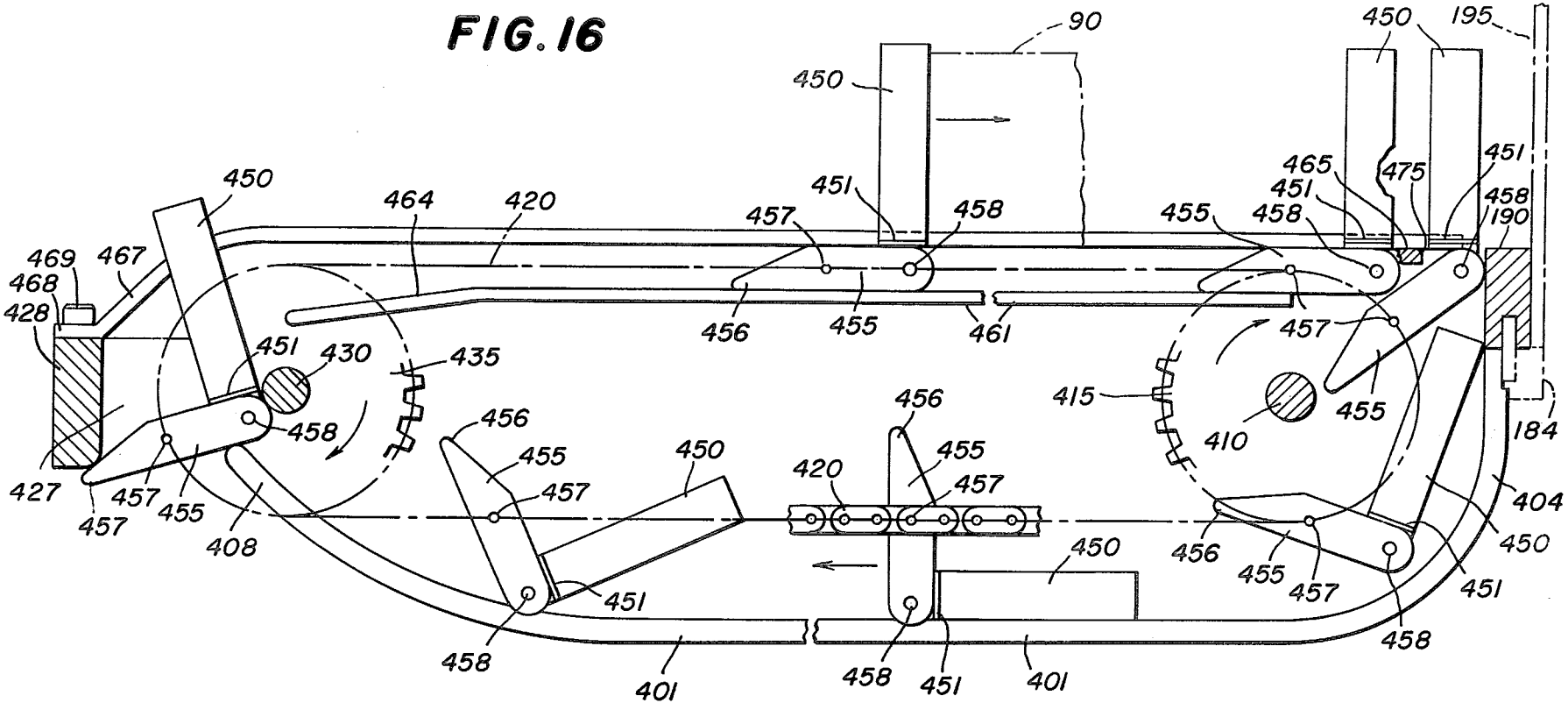
FIG. 16 is a diagrammatic view illustrating the operation of the product infeed conveyor that is used also as the product insertion mechanism.

As soon as the parts reach the position illustrated in FIG. 8, the right-handmost pusher 450 proceeds to be pulled downwardly (see FIG. 16 also) and it pushes the product support plate extension 495 out of position against the spring 498, the extension 495 heretofore having served to assure easy entry of the product 90 into the aligned carton 50. The carton pusher 450 continues downwardly and then to the left as illustrated in FIG. 16, this motion being accommodated by the pivotal connection of the pusher carriers 455 to the conveyor chains 420 and the further pivotal connection between the product pusher mounting plate 451 and the associated pusher carriers 455.

In the operation of the cartoner 100, the various parts thereof are adjusted so as to accommodate a particular size of carton 50 to be handled thereby and into which a correspondingly sized product 90 is to be inserted. The product infeed conveyor 400 is disposed on one side or the other of the carton conveyor 180, and for the purpose of this description, it will be assumed that the product infeed conveyor 400 has been installed as illustrated in FIG. 1. It is pointed out that the cartoner 100 has a wide range of adjustability as to the size and shape of the carton 50 to be handled thereby. The length of the carton may be from about $1\frac{3}{4}$ inches to about 12 inches, while the width of the carton may be from about $\frac{3}{4}$ inch to about $4\frac{1}{2}$ inches and the depth or height of the carton may be from about $\frac{5}{8}$ inch to about 3 inches. Although a reverse tuck closure has been shown on the carton 50, the machine can also handle a straight tuck closure. Also both hot melt glue and cold glue can be used as a closure mechanism with minor modifications. It is also pointed out that the product infeed conveyor 400 need not be used, and in fact any continuously operating infeed conveyor that can be synchronized with the carton conveyor 180 may be utilized, and the infeed conveyor may be parallel feed rather than perpendicular feed, and may even be a hand filling operation.

In order to adjust the cartoner 100 to the carton 50 being filled thereon, the three conveyor chains forming the carton conveyor 180 are appropriately adjusted. More specifically, the pushing conveyor 181 that is disposed on the side toward the product infeed conveyor 400 is placed in its outermost position, i.e., nearest to the outlet end from the product infeed conveyor 400. This movement of the conveyor 181 is accommodated by the sliding slot mounting thereof on the shafts 175 and 185 (see FIGS. 4 and 6, particularly). The intermediate conveyor 201 and the other outside conveyor 181 are adjusted toward the left-handmost conveyor 181 so as to accommodate the length of the carton 50 to be fed. The lugs 215 on the intermediate conveyor 201 are moved forwardly or rearwardly with respect to the aligned lugs 185 on the conveyors 181 so as to form a pocket that will accommodate the width of the carton 50 being conveyed. Next the top rails 240 are adjusted by means of the connectors 245 to position the lower surfaces of the top rails 240 away from the bottom rails 190 and 210 a distance to accommodate the depth of the carton 50. The end panel guide 276 and the rear tuck mechanism 280 are likewise adjusted to accommodate the depth or height of the carton 50 being closed, and the rear tuck mechanism 280 is further adjusted inwardly so as to accommodate the length of the carton 50 being closed. Finally, the folded carton magazine 120 has the bottom rails 125 and the upper rails 127 adjusted and the infeed conveyor 400 has the side guide rail 480 adjusted to accommodate the carton being fed.

The geneva drive mechanism 160 drives the carton conveyor 180 in a step-wise fashion, so that the folded carton 50 can be expanded and inserted in the associated pocket while the conveyor 180 is stationary and so that the product 90 can be inserted into the expanded carton 50 while the carton 50 is stationary. It will be noted however that the product infeed conveyor 400 can operate continuously, even though the carton conveyor 180 is operating in a step-wise fashion.

With the cartoner 100 adjusted to receive a particular carton 50, a stack 75 of those cartons 50 is placed in the folded carton magazine 120. The suitable controls 331 are actuated so as to energize the motor 130, thus supplying drive for the parts of the cartoner 100, including its product infeed conveyor 400. The geneva drive 160 drives the expanded carton conveyor 180 in a step-wise fashion while the cams 140 and 151 and the parts driven thereby operate in a continuous fashion, as does the product input conveyor 400. The parts are timed and arranged so that the carton conveyor 180 is stationary as the suction head 220 withdraws a folded carton 50 from the magazine 120. Contact of the carton 50 with the expander guides 230 partially expands the carton 50 and the forward edge is disposed beneath the shoulders 231 and essentially in the associated conveyor pocket as illustrated in FIG. 2. The carton conveyor 180 then is actuated by the geneva drive mechanism 160 to move the carton 50 under the entry sections 235 of the top carton rails 240 while the carton is supported by the bottom carton rails 190 and 210. It will be seen that the carton 50 soon clears the suction head 220 which then is returned toward the magazine 120 to engage the next carton 50 therein.

The now fully expanded carton 50 engages the front panel holder 255 which lifts the front end panel 57 out of the way to clear the opening in the end of the carton 50 and the front side flap 56 passes by the side flap spreader 490. At this time, the carton conveyor 180 again stops due to the action of the geneva drive mechanism 160 and the product infeed conveyor 400 pushes the next product 90 toward the open carton and against the side flap spreader 490 to move the side flap spreader 490 in a clockwise direction as viewed in FIG. 7, thus to move the leading front side flap 56 outwardly with respect to the opening in the carton 50. The product 90 is then pushed by the associated product pusher 450 across the outer end 475 of the product support plate 465, and across the product support plate extension 495 and into the waiting carton 50. The product pusher 450 moves downwardly against the product support plate extension 495 and pivots it in a clockwise direction as viewed in FIG. 9 out of the path of the engaged product pusher 450, thus permitting the product pusher 450 to pass adjacent to the carton guide rail 190 and thus push the product 90 fully into the open carton 50.

As the carton approached the filling station opposite the product infeed conveyor 400, the rear leading side flap 66 was pushed to the folded position by the side flap rail 263, and while the product 90 was being inserted into the carton 50, the rear trailing side flap folder 260 served to fold the trailing rear side flap 65 to the closed position. When the carton 50 was next moved forwardly by the carton conveyor 180, the trailing rear side flap 65 passed in front of the rail 263 so as to be held in the closed position. The leading front side flap 55 next engages the side flap rail 269 and is folded closed and thereafter the trailing front side flap 55 is engaged by the folder 265 to fold it to the closed position after which it passes behind the side flap rail 269 to be held in the closed position.

The rear breaker 270 and the front breaker 275 serve to give the initial folding action to the front end panel 57 and the rear end panel 67, respectively, after which the tuck mechanisms 280 and 300 close and complete the tuck of the rear end panel 67 and its associated rear tuck flap 68 on the one hand, and the front end panel 57 and the associated front tuck flap 58 on the other hand, respectively. After the closure of the carton 50, it is conveyed by the rails 320 to the output conveyor 325 for transport to the next operation therefor.

Quiet, smooth and long-life operation of the drive mechanism for the cartoner 100 is insured by a special construction of the geneva drive mechanism 160. More specifically, the geneva wheel 170 is formed of a polyurethane plastic which has incorporated therein molybdenum disulfide which serves as a lubricant for engagement with the various parts engaged by the geneva wheel 170. The geneva driver 165 is formed of a hard anodized aluminum which has the pores thereof impregnated with Teflon plastic. The materials of construction of the geneva wheel 170 and the driver 165 insure a quiet and efficient operation with a minimum of wear, both of the parts being self-lubricating.

While there has been described what is at present considered to be the preferred embodiment of the invention, it will be understood that various modifications may be made therein, and it is intended to cover in the appended claims all such modifications as fall within the true spirit and scope of the invention.

We claim:

1. A cartoner for inserting a product into an expanded carton having at least one end open and thereafter closing the open end, wherein the cartoner is adjustable to a wide variety of carton shapes and sizes, said cartoner comprising an expanded carton conveyor including three conveyor chains each having equidistantly spaced lugs therealong extending therefrom, the lugs on two of said conveyor chains being in lateral alignment and spaced longitudinally from the lugs on the other of said conveyor chains to provide a pocket receiving an expanded carton therein, mechanism supporting and driving said three conveyor chains along a path from the input end of said cartoner to the output end of said cartoner, said mechanism including geneva drive means for effecting stepwise movement of said conveyor chains, a bottom rail supporting the cartons in said pockets and a top rail guiding the upper surfaces of the cartons to hold the cartons in the pockets as the cartons are carried by said conveyor, said supporting and driving mechanism including adjustment means for accommodating movement of two of said conveyor chains laterally toward and away from each other and the other conveyor chain to adjust the length of the pockets defined by said lugs to accommodate different lengths of cartons, the longitudinal distance between the two laterally aligned sets of lugs and the other set of lugs being adjustable to adjust the width of the pockets defined by said lugs to accommodate different widths of cartons, said top rail being adjustable toward and away from said bottom rail to adjust the depth of the pockets defined by said lugs to accommodate different depths of cartons, an expanded carton feed mechanism adjacent to the input end of said cartoner for depositing expanded cartons one-by-one into the pockets on said expanded carton conveyor from thereabove, a product infeed and filling mechanism adjacent to said cartoner between the input end and the output end of said cartoner for depositing product one-by-one into the cartons in said pockets, means synchronizing the operation of said expanded carton feed mechanism and said product infeed and filling mechanism with said geneva drive means so that the expanded cartons are deposited into the pockets and the product is deposited into the expanded cartons when said expanded carton conveyor is stationary, and closure mechanism on said cartoner between said product infeed and filling mechanism and the output end of said cartoner for closing said cartons with the product therein.

2. The cartoner set forth in claim 1, wherein all three of said conveyor chains are adjustable laterally toward and away from each other.

3. The cartoner set forth in claim 1, wherein said expanded carton feed mechanism includes a magazine for holding cartons in a flattened condition, and mechanism to expand the cartons one-by-one from the flattened condition to the expanded condition.

4. The cartoner set forth in claim 1, wherein said two conveyor chains and said other conveyor chain are adjustable to accommodate cartons having lengths in the range from about 1¾ inch to about 12 inches, said top rail is adjustable toward and away from said bottom rail to accommodate cartons having depths in the range from about ⅝ inch to about 3 inches, and the longitudinal distance between the two laterally aligned sets of lugs and the other sets of lugs can be adjusted to accommodate cartons having widths in the range from about ¾ inch to about 4½ inches.

5. A cartoner for inserting a product into either end of an expanded carton having at least one end open and thereafter closing the open end, said cartoner comprising an expanded carton conveyor including three conveyor chains each having equidistantly spaced lugs therealong extending therefrom, the lugs on two of said conveyor chains being in lateral alignment and spaced longitudinally from the lugs on the other of said conveyor chains to provide a pocket receiving an expanded carton therein, mechanism supporting and driving said three conveyor chains along a path from the input end of said cartoner to the output end of said cartoner, said mechanism including geneva drive means for effecting stepwise movement of said conveyor chains, a bottom rail supporting the cartons in said pockets and a top rail guiding the upper surfaces of the cartons to hold the cartons in the pockets as the cartons are carried by said conveyor, a product infeed and filling mechanism adapted to be disposed on either side of said cartoner between the input end and the output end of said cartoner for depositing product one-by-one into the cartons in said pockets from either side of said expanded carton conveyor, said supporting and driving mechanism including adjustment means for accommodating movement of all of said conveyor chains laterally toward and away from each other to adjust the length of the pockets defined by said lugs to accommodate different lengths of cartons and toward and away from the side of said expanded carton conveyor on which said product infeed and filling mechanism is disposed, an expanded carton feed mechanism adjacent to the input end of said cartoner for depositing expanded cartons one-by-one into the pockets on said expanded carton conveyor from thereabove, means synchronizing the operation of said expanded carton feed mechanism and said product infeed and filling mechanism with said geneva drive means so that the expanded cartons are deposited into the pockets and the product is deposited into the expanded cartons when said expanded carton conveyor is stationary, and closure mechanism on said cartoner between said product infeed and filling mechanism and the output end of said cartoner for closing said cartons with the product therein.

6. The cartoner set forth in claim 5, wherein the conveyor chain on the product feed side is disposed close to the outlet from the product infeed and filling mechanism.

7. A cartoner for inserting a product into either end of an expanded carton having at least one end open and thereafter closing the open end, wherein the cartoner is adjustable to a wide variety of carbon shapes and sizes, said cartoner comprising an expanded carton conveyor including three conveyor chains each having equidistantly spaced lugs therealong extending therefrom, the lugs on two of said conveyor chains being in lateral alignment and spaced longitudinally from the lugs on the other of said conveyor chains to provide a pocket receiving an expanded carton therein, mechanism supporting and driving said three conveyor chains along a path from the input end of said cartoner to the output end of said cartoner, said mechanism including geneva drive means for effecting stepwise movement of said conveyor chains, a bottom rail supporting the cartons in said pockets and a top rail guiding the upper surfaces of the cartons to hold the cartons in the pockets as the cartons are carried by said conveyor, a product infeed and filling mechanism adapted to be disposed on either side of said cartoner between the input end and the output end of said cartoner for depositing product one-by-one into the cartons in said pockets from either side of said expanded carton conveyor, said supporting and driving mechanism including adjustment means for accommodating movement of all of said conveyor chains laterally toward and away from each other and the other conveyor chain to adjust the length of the pockets defined by said lugs to accommodate different lengths of cartons and toward and away from the side of said expanded carton conveyor on which said product infeed and filling mechanism is disposed, the distance between the two laterally aligned sets of lugs and the other set of lugs being adjustable to adjust the width of the pockets defined by said lugs to accommodate different widths of cartons, said top rail being adjustable toward and away from said bottom rail to adjust the depth of the pockets defined by said lugs to accommodate different depths of cartons, an expanded carton feed mechanism adjacent to the input end of said cartoner for depositing expanded cartons one-by-one into the pockets on said expanded carton conveyor from thereabove, means synchronizing the operation of said expanded carton feed mechanism and said product infeed and filling mechanism with said geneva drive means so that the expanded cartons are deposited into the pockets and the product is deposited into the expanded cartons when said expanded carton conveyor is stationary, and closure mechanism on said cartoner between said product infeed and filling mechanism and the output end of said cartoner for closing said cartons with the product therein.

8. The cartoner set forth in claim 7, wherein the conveyor chain on the product feed side is disposed close to the outlet from the product infeed and filling mechanism.

9. A cartoner for inserting a product into an expanded carton having at least one end open and thereafter closing the open end, said cartoner comprising an expanded carton conveyor having a plurality of longitudinally spaced-apart pockets for receiving an expanded carton therein, mechanism supporting and driving said carton conveyor along a path from the input end of said cartoner to the output end of said cartoner, a bottom rail supporting the cartons in said pockets and a top rail guiding the upper surfaces of the cartons to hold the cartons in the pockets as the cartons are carried by said carton conveyor, an expanded carton feed mechanism adjacent to the input end of said cartoner for depositing cartons one-by-one into the pockets on said expanded carton conveyor, a product infeed conveyor including a product support plate and a conveyor chain carrying a plurality of longitudinally spaced-apart product pushers pivotally connected to said conveyor chain for pushing product along said product support plate, the output end of said product infeed conveyor being positioned immediately adjacent to one side of said carton conveyor intermediate the ends thereof with said product support plate being spaced away from said bottom rail a distance just to permit passage of said product pushers therebetween, guide means for said product pushers guiding said product pushers toward the open ends of the cartons carried by said carton conveyor and up to a position immediately adjacent thereto to insert the product engaged by a product pusher into the associated open carton, and closure mechanism on said cartoner between said product infeed mechanism and the output end of said cartoner for closing said cartons with the product therein.

10. The cartoner set forth in claim 9, wherein each of said product pushers is pivotally connected to a pusher carrier that is in turn pivotally connected to the product infeed conveyor chain.

11. The cartoner set forth in claim 9, wherein said product infeed conveyor is operated in synchronism with said expanded carton conveyor.

12. The cartoner set forth in claim 9, wherein said product infeed conveyor and said carton conveyor mechanism have a common source of power.

13. The cartoner set forth in claim 9, and further comprising side guide rails disposed on either side of the product conveyed by said product infeed conveyor for guiding the same into an associated carton on said expanded carton conveyor.

14. The cartoner set forth in claim 13, wherein one of said side guide rails is adjustable toward and away from the other of said side guide rails to accommodate products of different widths.

15. A cartoner for inserting a product into an expanded carton having at least one end open and thereafter closing the open end, said cartoner comprising an expanded carton conveyor having a plurality of longitudinally spaced-apart pockets for receiving an expanded carton therein, mechanism supporting and driving said carton conveyor along a path from the input end of said cartoner to the output end of said cartoner, a bottom rail supporting the cartons in said pockets and a top rail guiding the upper surfaces of the cartons to hold the cartons in the pockets as the cartons are carried by said carton conveyor, an expanded carton feed mechanism adjacent to the input end of said cartoner for depositing cartons one-by-one into the pockets on said expanded carton conveyor, a product infeed conveyor including a product support plate and a conveyor chain carrying a plurality of longitudinally spaced-apart product pushers pivotally connected to said conveyor chain for pushing product along said product support plate, the output end of said product infeed conveyor being positioned immediately adjacent to one side of said carton conveyor intermediate the ends thereof with said product support plate being spaced away from said bottom rail a distance just to permit passage of said product pushers therebetween, a product support plate extension pivotally mounted adjacent to the space between the output end of said product support plate and said bottom rail for closing the space during the passage of product thereover, said product support plate extension being pivotal out of the path of each product pusher as the product pusher reaches the bottom rail to permit passage of the product pusher downwardly between the exit end of said product support plate and said bottom rail, guide means for said product pushers guiding said product pushers toward the open ends of the cartons carried by said carton conveyor and up to a position immediately adjacent thereto to insert the product engaged by a product pusher into the associated open carton, and closure mechanism on said cartoner between said product infeed mechanism and the output end of said cartoner for closing said cartons with the product therein.

16. The cartoner set forth in claim 15, wherein said product support plate extension is pivotally mounted upon said product infeed conveyor.

17. The cartoner set forth in claim 15, and further comprising a spring continually urging said product support plate extension into a position closing the space between said product support plate and said bottom rail.

18. A cartoner for inserting a product into an expanded carton having at least one open end with side flaps adjacent thereto and thereafter closing the side flaps and the open end, said cartoner comprising an expanded carton conveyor having a plurality of longitudinally spaced-apart pockets for receiving an expanded carton therein, mechanism supporting and driving said carton conveyor along a path from the input end of said cartoner to the output end of said cartoner, a bottom rail supporting the cartons in said pockets and a top rail guiding the upper surfaces of the cartons to hold the cartons in the pockets as the cartons are carried by said carton conveyor, an expanded carton feed mechanism adjacent to the input end of said cartoner for depositing cartons one-by-one into the pockets on said expanded carton conveyor, a product infeed conveyor including a conveyor chain carrying a plurality of longitudinally spaced-apart product pushers pivotally connected to said conveyor chain, the output end of said product infeed conveyor being positioned immediately adjacent to one side of said carton conveyor intermediate the ends thereof and immediately adjacent to the open ends of the cartons carried by said carton conveyor, a side flap spreader mounted adjacent to the output end of said product infeed conveyor in position to engage and spread a side flap on the associated carton in alignment with the output end of said product infeed conveyor for receiving a product therefrom, guide means for said product pusher guiding said product pushers toward the open ends of the carton carried by said carton conveyor and up to a position immediately adjacent thereto to insert the product engaged by a product pusher into the associated open carton, and closure mechanism on said cartoner between said product infeed mechanism and the output end of said cartoner for closing said cartons with the product therein.

19. The cartoner set forth in claim 18, wherein said side flap spreader is pivotally mounted and biased toward the flap-engaging position thereof.

20. The cartoner set forth in claim 18, and further comprising side guide rails adjacent to said product support plate for laterally guiding product thereon, said side flap spreader being mounted on one of said side guide rails.

21. The cartoner set forth in claim 18, and further comprising side guide rails adjacent to said product support plate for laterally guiding product engaged by said product pushers, one of said side guide rails being adjustable toward and away from the other of said side guide rails to accommodate different widths of products, said side flap spreader being mounted on said adjustable side guide rail for adjustment therewith.

22. A cartoner for inserting a product into an expanded carton having at least one open end with side flaps adjacent thereto and thereafter closing the side flaps and the open end, said cartoner comprising an expanded carton conveyor having a plurality of longitudinally spaced-apart pockets for receiving an expanded carton therein, mechanism supporting and driving said carton conveyor along a path from the input end of said cartoner to the output end of said cartoner, a bottom rail supporting the cartons in said pockets and a top rail guiding the upper surfaces of the cartons to hold the cartons in the pockets as the cartons are carried by said carton conveyor, an expanded carton feed mechanism adjacent to the input end of said cartoner for depositing cartons one-by-one into the pockets on said expanded carton conveyor, a product infeed conveyor including a product support plate and a conveyor chain carrying a plurality of longitudinally spaced-apart product pushers pivotally connected to said conveyor chain for pushing product along said product support plate, the output end of said product infeed conveyor being positioned immediately adjacent to one side of said carton conveyor intermediate the ends thereof with said product support plate being spaced away from said bottom rail a distance just to permit passage of said product pushers therebetween, a product support plate extension pivotally mounted adjacent to the space between the output end of said product support plate and said bottom rail for closing the space during the passage of product thereover, said product support plate extension being pivotal out of the path of each product pusher as the product pusher reaches the bottom rail to permit passage of the product pusher downwardly between the exit end of said product support plate and said bottom rail, a side flap spreader mounted adjacent to the output end of said product infeed conveyor in position to engage and spread a side flap on the associated carton in alignment with the output end of said product infeed conveyor for receiving a product therefrom, guide means for said product pushers guiding said product pushers toward the open ends of the carton carried by said carton conveyor and up to a position immediately ajdacent thereto to insert the product engaged by a product pusher into the associated open carton, and closure mechanism on said cartoner between said product infeed mechanism and the output end of said cartoner for closing said cartons with the product therein.

23. The cartoner set forth in claim 22, wherein said product infeed conveyor includes two laterally spaced-apart conveyor chains carrying a plurality of longitudinally spaced apart pusher carriers pivotally connected thereto and pivotally connected to said product pushers.

24. The cartoner set forth in claim 22, and further comprising two laterally spaced-apart side guide rails mounted adjacent to said product support plate for laterally guiding product being carried therealong.

25. The cartoner set forth in claim 24, wherein one of said side guide rails is adjustable toward and away from the other of said side guide rails to accommodate different widths of product.

26. The cartoner set forth in claim 22, wherein said product support extension is pivotally mounted on said product support plate, and a spring is provided urging said product support extension into the space closing position thereof.

27. The cartoner set forth in claim 22, wherein said side flap spreader is pivotally mounted and is spring urged into the flap-engaging position thereof.

28. The cartoner set forth in claim 22, and further comprising side guide rails adjacent to said product support plate for guiding product therealong, one of said side guide rails being adjustable toward and away from the other side guide rail to accommodate different widths of product, said side flap spreader being mounted on said adjustable side guide rail.

29. A product infeed conveyor for use with a cartoner having an expanded carton conveyor with spaced-apart pockets for expanded cartons and a bottom rail for supporting the cartons in the pockets, said product infeed conveyor comprising a product support plate extending laterally from the associated carton conveyor intermediate the ends thereof, a conveyor chain adjacent to said product support plate and carrying a plurality of longitudinally spaced-apart product pushers pivotally connected to said conveyor chain for pushing product along said product support plate, the output end of said product support plate being positioned immediately adjacent to the associated bottom rail with a distance therebetween to receive said product pushers therethrough, and guide means for said product pushers guiding said product pushers toward the open ends of the cartons carried by the associated carton conveyor and up to a position immediately adjacent thereto to insert the product engaged by a product pusher into the associated open carton and thereafter guiding the product pushers through the space between the end of said product support plate and the associated bottom rail, whereby said product infeed conveyor serves both to feed product to the associated cartoner and to insert the product into the open cartons thereon.

30. The product infeed conveyor set forth in claim 29, and further comprising two conveyor chains for said product pushers, a plurality of pusher carriers pivotally mounted on and between said conveyor chains and pivotally connected to said product pushers.

31. The product infeed conveyor set forth in claim 29, and further comprising side guide rails adjacent to said product support plate for guiding the product therealong.

32. The product infeed conveyor set forth in claim 31, wherein one of said side guide rails is adjustable toward and away from the other side guide rail so as to accommodate different widths of product.

33. A product infeed conveyor for use with a cartoner having an expanded carton conveyor with spaced-apart pockets for expanded cartons and a bottom rail for supporting the cartons in the pockets, said product infeed conveyor comprising a product support plate extending laterally from the associated carton conveyor intermediate the ends thereof, a conveyor chain adjacent to said product support plate and carrying a plurality of longitudinally spaced-apart product pushers pivotally connected to said conveyor chain for pushing product along said product support plate, the output end of said product support plate being positioned immediately adjacent to the associated bottom rail with a distance therebetween to receive said product pushers therethrough, a product support plate extension pivotally mounted adjacent to the space between the output end of said product support plate and the bottom rail for closing the space during the passage of product thereover; said product support plate extension being pivotal out of the path of each product pusher as the product pusher reaches the bottom rail to permit passage of the product pusher downwardly between the exit end of said product support plate and the bottom rail, and guide means for said product pushers guiding said product pushers toward the open ends of the cartons carried by the associated carton conveyor and up to a position immediately adjacent thereto to insert the product engaged by a product pusher into the associated open carton and thereafter guiding the product pushers through the space between the end of said product support plate and the associated bottom rail, whereby said product infeed conveyor serves both to feed product to the associated cartoner and to insert the product into the open cartons thereon.

34. The product infeed conveyor set forth in claim 33, wherein said product support plate extension is pivoted on said product support plate and is spring urged into the position closing the space.

35. A product infeed conveyor for use with a cartoner having an expanded carton conveyor with spaced-apart pockets for expanded cartons having at least one open end with side flaps adjacent thereto and a bottom rail for supporting the cartons in the pockets, said product infeed conveyor comprising a product support plate extending laterally from the associated carton conveyor intermediate the ends thereof, a conveyor chain adjacent to said product support plate and carrying a plurality of longitudinally spaced-apart product pushers pivotally connected to said conveyor chain for pushing product along said product support plate, the output end of said product support plate being positioned immediately adjacent to the associated bottom rail with a distance therebetween to receive said product pushers therethrough, a side flap spreader mounted adjacent to the output end of said product support plate in position to engage and spread a side flap on the associated carton in alignment with the output end of said product support plate for receiving a product therefrom, and guide means for said product pushers guiding said product pushers toward the open ends of the cartons carried by the associated carton conveyor and up to a position immediately adjacent thereto to insert the product engaged by a product pusher into the associated open carton and thereafter guiding the product pushers through the space between the end of said product support plate and the associated bottom rail, whereby said product infeed conveyor serves both to feed product to the associated cartoner and to insert the product into the open cartons thereon.

36. The product infeed conveyor set forth in claim 35, wherein said side flap spreader is pivotally mounted and is spring urged toward the flap-engaging position.

37. The product infeed conveyor set forth in claim 35, and further comprising side guide rails adjacent to said product support plate for laterally guiding product thereon, said side flap spreader being mounted on one of said side guide rails.

38. The product infeed conveyor set forth in claim 37, wherein said side guide rail on which said side flap spreader is mounted is adjustable toward and away from the other side guide rail to accommodate different widths of product therebetween.

39. A product infeed conveyor for use with a cartoner having an expanded carton conveyor with spaced-apart pockets for expanded cartons having at least one open end with side flaps adjacent thereto and a bottom rail for supporting the cartons in the pockets, said product infeed conveyor comprising a product support plate extending laterally from the associated carton conveyor intermediate the ends thereof, a conveyor chain adjacent to said product support plate and carrying a plurality of longitudinally spaced-apart product pushers pivotally connected to said conveyor chain for pushing product along said product support plate, the output end of said product support plate being positioned immediately adjacent to the associated bottom rail with a distance therebetween to receive said product pushers therethrough, a product support plate extension pivotally mounted adjacent to the space between the output end of said product support plate and the bottom rail for closing the space during the passage of product thereover, said product support plate extension being pivotal out of the path of each product pusher as the product pusher reaches the bottom rail to permit passage of the product pusher downwardly between the exit end of said product support plate and said bottom rail, a side flap spreader mounted adjacent to the output end of said product support plate in position to engage and spread a side flap on the associated carton in alignment with the output end of said product support plate for receiving a product therefrom, and guide means for said product pushers guiding said product pushers toward the open ends of the cartons carried by the associated carton conveyor and up to a position immediately adjacent thereto to insert the product engaged by a product pusher into the associated open carton and thereafter guiding the product pushers through the space between the end of said product support plate and the associated bottom rail, whereby said product infeed conveyor serves both to feed product to the associated cartoner and to insert the product into the open cartons thereon.

40. The product infeed conveyor set forth in claim 39, wherein said product infeed convveyor includes two laterally spaced-apart conveyor chains carrying a plurality of longitudinally spaced-apart pusher carriers pivotally connected thereto and pivotally connected to said product pushers.

41. A product infeed conveyor as set forth in claim 39, and further comprising two laterally spaced-apart side guide rails mounted adjacent to said product support plate for laterally guiding product being carried therealong.

42. A product infeed conveyor as set forth in claim 41, wherein one of said side guide rails is adjustable toward and away from the other of said side guide rails to accommodate different widths of product.

43. The product infeed conveyor set forth in claim 39, wherein said product support extension is pivotally mounted on said product support plate, and a spring is provided urging said product support extension into the space closing position thereof.

44. The product infeed conveyor set forth in claim 39, wherein said side flap spreader is pivotally mounted and is spring urged into the flap-engaging position thereof.

45. The product infeed conveyor set forth in claim 39, and further comprising side guide rails adjacent to said product support plate for guiding product therealong, one of said side guide rails being adjustable toward and away from the other side guide rail to accommodate different widths of product, said side flap spread being mounted on said adjustable side guide rail.

46. A cartoner for inserting a product into an expanded carton having at least one end open and thereafter closing the open end, wherein the cartoner is adjustable to a wide variety of carton shapes and sizes, said cartoner comprising an expanded carton conveyor including three conveyor chains each having equidistantly spaced lugs therealong extending therefrom, the lugs on two of said conveyor chains being in lateral alignment and spaced longitudinally from the lugs on the other of said conveyor chains to provide a pocket receiving an expanded carton therein, mechanism supporting and driving said three conveyor chains along a path from the input end of said cartoner to the output end of said cartoner, said mechanism including a geneva wheel and a geneva driver operating in a step-by-step manner, said geneva wheel being formed of polyurethane resin with molybdenum disulfide incorporated therein to provide a strong and quiet and self-lubricating structure, said geneva driver being formed of hard anodized aluminum with Teflon embedded in the pores of the anodized aluminum to provide a self-lubricating structure, a bottom rail supporting the cartons in said pockets and a top rail rail guiding the upper surfaces of the cartons to hold the cartons in the pockets as the cartons are carried by said conveyor, two of said conveyor chains being adjustable laterally toward and away from each other and the other conveyor chain to adjust the length of the pockets defined by said lugs to accommodate different lengths of cartoons, the longitudinal distance between the two laterally aligned sets of lugs and the other set of lugs being adjustable to adjust the width of the pockets defined by said lugs to accommodate different widths of cartons, said top rail being adjustable toward and away from said bottom rail to adjust the depth of the pockets defined by said lugs to accommodate different depths of cartons, an expanded carton feed mechanism adjacent to the input end of said cartoner for depositing cartons one-by-one into the pockets on said expanded carton conveyor, a product infeed and filling mechanism adjacent to said cartoner between the input end and the output end of said cartoner for depositing product one-by-one into the cartons in said pockets, and closure mechanism on said cartoner between said product infeed and filling mechanism and the output end of said cartoner for closing said cartons with the product therein.

* * * * *